US011257469B2

(12) United States Patent
Feldman

(10) Patent No.: US 11,257,469 B2
(45) Date of Patent: Feb. 22, 2022

(54) ENDPIN BLOCK APPARATUS FOR STRINGED INSTRUMENTS

(71) Applicant: Emmanuel Simon Feldman, West Newton, MA (US)

(72) Inventor: Emmanuel Simon Feldman, West Newton, MA (US)

( * ) Notice: Subject to any disclaimer, the term of this patent is extended or adjusted under 35 U.S.C. 154(b) by 218 days.

(21) Appl. No.: 16/575,363

(22) Filed: Sep. 18, 2019

(65) Prior Publication Data

US 2020/0090631 A1 Mar. 19, 2020

Related U.S. Application Data

(60) Provisional application No. 62/733,063, filed on Sep. 18, 2018.

(51) Int. Cl.
*G10D 3/01* (2020.01)

(52) U.S. Cl.
CPC ..... *G10D 3/01* (2020.02)

(58) Field of Classification Search
CPC ..... G10D 3/01
USPC ..... 84/280
See application file for complete search history.

(56) References Cited

U.S. PATENT DOCUMENTS 4,586,418 A * 5/1986 Stahlhammer ..... G10D 3/01 84/280

FOREIGN PATENT DOCUMENTS

| | | | |
|---|---|---|---|
| SE | 538249 | C2 | 7/2013 |
| SE | 1600241 | A1 | 2/2018 |
| WO | 2009/105006 | A1 | 8/2009 |

OTHER PUBLICATIONS

Mario Lamarre, Lamario Luthier, Double bass endpin angled lamax system installation, Feb. 12, 2017, https://www.youtube.com/watch?v=EjfOQo8_Ubs (Year: 2017).*

Stahlhammer Cello Endpins. Product information website [online]. Published by Semmy Stahlhammer, 2019 [retrieved on Sep. 16, 2019]. Retrieved from the Internet: <URL: https://semmystahlhammer.se/cello%20endpin.html>.

Upton Bass Angled Double Bass Endpin Block. Product information website [online]. Published by Upton Bass String Instrument Co., 2019 [retrieved on Sep. 16, 2019]. Retrieved from the Internet: <URL: https://uptonbass.com/product/upton-bass-endpin-angle-block/>.

(Continued)

*Primary Examiner* — Jianchun Qin
(74) *Attorney, Agent, or Firm* — Matthew M. Yospin

(57) ABSTRACT

Improved endpin block apparatus for stringed instruments are provided. The endpin block apparatus comprises an endpin support for securing and connecting an endpin to a stringed instrument. The endpin block apparatus may be fixedly attached to the instrument or may be able to rotate about an attachment location, allowing for adjustment of the angle of the instrument relative to the axis defined by the endpin and the musician. The endpin block apparatus provides one or more endpin insertion locations, allowing for one or more angles of the endpin relative to the axis of the instrument, which angle may be adjustable, and may allow for more of the instrument's weight to be borne by the endpin. The adjustable endpin angle and the adjustable endpin block apparatus rotation allow for a greater range of instrument location and angle, and more support of the instrument by the endpin, removing weight from the musician.

7 Claims, 28 Drawing Sheets

(56) References Cited

OTHER PUBLICATIONS

Endpin Angled Lammax System. Product information website [online]. Published by Mario Lamarre, 2016 [retrieved on Sep. 16, 2019]. Retrieved from the Internet: <URL: http://www.lamario.ca/lammax.php?lang=en>.

* cited by examiner

ENDPIN BLOCK APPARATUS FOR STRINGED INSTRUMENTS

FIELD OF THE INVENTION

The presently disclosed subject matter relates to endpin block apparatus for stringed instruments, and more particularly, to endpin block apparatus that allow adjustment of the endpin through a range of angles in one or two planes relative to the instrument.

BACKGROUND OF THE INVENTION

Large stringed instruments, including but not limited to the cello and the upright bass, are heavy instruments that must be supported on the floor, in nearly all uses of the instruments, so that a musician can play them. Traditionally, instruments are supported with a straight endpin that protrudes from the bottom of the instrument, known as the lower rib area. The endpin is braced to the instrument with a small endpin support that is external to the instrument and which in most instances has an element that spans into the internal space of the instrument, in contact with a part of the instrument that is a reinforcing block inside the lower rib area of the instrument, which reinforcing block is in contact with the inside surface of the instrument body panels comprising the lower rib area. Traditional endpins protrude straight out of the instrument, parallel to the long axis of the instrument and perpendicular to the exterior surface of the instrument at the lower rib area. They can be adjusted for length but not adjusted to be affixed to the instrument at any other angle, or to be affixed in any location other than a single hole placed in the lower rib area of the instrument, which hole is typically in the center of the lower rib area. Such an endpin is depicted in FIG. 1A. For definition of a reference frame, if one faces an upright instrument with the strings approximately vertical and facing the viewer, the x axis is side-to-side along the instrument, the y-axis is front to back on the instrument, and the z-axis is vertical along the instrument.

Angled endpins are known in the art as well, in which the endpin is supported at the center of the lower rib area of the instrument, but departs from the lower rib area in the y-z plane (as defined by the plane comprising the y-axis and the z-axis), away from the front of the instrument, and in line with the center line of the instrument along the z-axis. Such an endpin is depicted in FIG. 1B. Such endpins typically cannot be adjusted for angle: they are fixed at a particular angle in the y-z plane, and cannot be rotated about the z-axis. Further, while such endpins are angled along the y-z plane, they are not angled sharply enough to be under or nearly under the center of mass of the instrument. While there are limited examples in existence of angled endpins that can be rotated about the z-axis, they are generally poorly supported by or attached to the instrument at or near the hole in the lower rib area, and are disfavored by musicians.

The current state of the art of endpin supports—which may also be referred to in the present disclosure as an endpin block or endpin block apparatus—for stringed instruments presents several problems. First, they do not support as much of the weight of the instrument as they could if the endpin were closer to being directly under the center of mass of the instrument. To do so, the endpin's attachment location to the endpin support would need to be sharply angled, or angled and offset from the hole in the center of the lower rib area. It could then make contact with the ground at an angle of approximately 90°. Such an endpin support, referred to in this disclosure of the present invention as an endpin block apparatus, would allow the endpin to bear most of the weight of the instrument, with the instrument approximately balanced above the endpin where the endpin contacts the floor.

The current state of endpins and endpin block apparatuses leaves much of the weight of the instrument on the musician, with the instrument's center of mass between the musician and the endpin, forcing the musician to hold the heavy instrument that is leaning on her or him, while the musician is sitting or standing and playing the instrument. Bearing this weight has effects on the musician: first, it tends to lead to injuries, including but not limited to repetitive stress injuries, as musicians force themselves into awkward postures or put stresses on their backs, legs, arms, and/or shoulders to support the weight of the instrument while also playing the instrument. This can lead to a range of injuries related to poor ergonomics. Second, being required to hold up a relatively heavy instrument while playing can impact the playing, and ability of the musicians to express themselves musically, by constraining their motions.

To address these problems, some musicians modify or attempt to modify their instruments. This is risky because some changes, such as enlarging the hole in the lower rib area, or adding a second hole to the lower rib area, are difficult or impossible to reverse. They can cause damage that permanently affects the sound and performance of the instrument. And if such changes are made to an instrument and they are not in quite the right place on the instrument, they may reduce or destroy the ability of anyone to play the instrument. Furthermore, making such changes may be expensive, especially if a musician hires an expert luthier.

The accessories relating to endpins, angled endpins, and endpin supports that are currently in use don't allow for adjustability of the endpin, other than two accessories that are known in the art. One of these allows for a choice of two endpin positions: either straight in line with the z-axis from the hole in the lower rib area, or angled in the y-z plane and originating from the hole in the lower rib area. The other known accessory allows for rotation of the endpin exit angle (such that the endpin leaves the instrument not in the y-z plane, but rather in a plane that is perpendicular to the x-y plane and rotated around the z-axis. The endpin in this accessory is attached to a cantilever arm that is attached only to a stock endpin support, with no additional bracing against the lower rib area. This leads to a significantly increased torque from the endpin, due to the cantilever arm, on the endpin support and on the hole in the lower rib area of the instrument. This increased increases torque on the instrument significantly increases the risk of damage to the instrument.

Accordingly, the problems with the prior art for endpin support apparatus for stringed instruments include inadequate support of the instrument by the endpin block apparatus; injuries to musicians due to repetitive stress injuries and poor ergonomics of supporting the weight of a heavy instrument with arm, shoulder, or torso while needing to move to play the instrument; difficulty playing expressively or freely for many musicians due to the need to support the instrument while also moving to play; difficulty and expense of modifications to the instrument; the risk of damage to the instrument in making modifications or adjustments; the irreversibility of modifications to instruments, even if such modifications do not damage the instrument; and low or no adjustability by the musician once the endpin support is chosen and installed.

SUMMARY OF THE INVENTION

The present invention meets all these needs, by disclosing endpin block apparatus for stringed instruments that may be retrofitted onto a string instrument with little or no irreversible modifications to the instrument, with much reduced or no risk of damaging the instrument, and which may thereafter be repeatedly adjusted by the musician without any technical skill at engineering or modifying instruments. The present invention facilitates improved support of a stringed instrument and improved adjustability by each musician playing an instrument.

The present invention allows people to quickly and easily retrofit their instruments, or to hire a luthier or any person skilled at modifying or repairing instruments, by installing the improved endpin block apparatus. The presently disclosed invention enables improved support of each instrument, by allowing for an adjustable range of angles for the endpins relative to the instrument, and by allowing the endpin to depart from the instrument at an offset distance from the hole in the lower rib area. Such endpin block apparatus allow the endpin to contact the floor more nearly under the center of mass of the instrument, when the instrument is held in the position in which a musician plays it, allowing for the endpin to support nearly all of the weight of the instrument with the instrument approximately balanced over the endpin, and reducing the risk of the instrument sliding or being damaged.

By providing much improved support for the instrument, the force the musician is required to use to hold up the instrument is much reduced. Accordingly, the risk of ergonomic or repetitive stress injuries for the musician is greatly reduced, as the musician is not required to hold up the instrument while moving to play the instrument, and can move to play the instrument without needing to bear the weight of the instrument and move it while moving to play the instrument. A further advantage of the present invention is the possibility of improved sound from the instrument when the endpin meets the floor at an angle closer to 90°. It is believed that this improvement results from the instrument vibrating more freely, relative to the prior art, by reducing the strain on the endpin (relative to the prior art endpin support apparatuses, which have the endpin contact the floor at angles in the vicinity of 45°, plus or minus 15° for most prior art endpin support apparatuses) and therefore reducing the damping effect of the endpin on the instrument's vibrations.

The present invention also reduces the risk of damage to the instrument, and the danger of making modifications to instruments, that are present in the current state of known endpins, by presenting adjustable endpins that do not require dangerous and potentially damaging modifications to the instrument.

Furthermore, the present invention allows for adjustment of the endpin (its angle, offset, and rotation) by the musician, repeatedly and simply. This represents a great improvement over the current art, in which endpin adjustment is difficult or impossible.

In one aspect, the present invention comprises an endpin block body, an x-axis barrel, a block barrel bore 206 sized and disposed in the x-axis endpin block to hold the x-axis barrel, an endpin shaft holder, a block combined hole, a tailgut-shaft-holder contact surface, and an endpin stopper block void for holding the endpin at a desired angle relative to the x-axis endpin block; and in which the x-axis barrel further comprises a barrel screw, a barrel threading, and a barrel hole.

In one aspect, the present invention comprises an endpin block body, an x-axis barrel, a block barrel bore sized and disposed in the x-axis endpin block to hold the x-axis barrel, an endpin shaft holder, a block straight hole and a block angled hole, a tailgut-shaft-holder contact surface, and a worm drive and a barrel lock gear which engage with each other, and which barrel lock gear is affixed to the x-axis barrel, for holding the endpin at a desired angle relative to the x-axis endpin block; and in which the x-axis barrel further comprises a barrel screw, a barrel threading, and a barrel hole.

In one aspect, the present invention comprises an endpin block body, an x-axis barrel, a block barrel bore sized and disposed in the x-axis endpin block to hold the x-axis barrel, an endpin shaft holder, a plurality of holes in the block for the endpin, a tailgut-shaft-holder contact surface, and a plurality of elements for holding the endpin at a desired angle relative to the x-axis endpin block; and in which the x-axis barrel further comprises a barrel screw, a barrel threading, and a barrel hole.

In one aspect, the present invention comprises a plurality of elements for holding the endpin at a desired angle relative to the x-axis endpin block, which comprise a barrel set screw.

In one aspect, the present invention comprises a plurality of elements for holding the endpin at a desired angle relative to the x-axis endpin block, which comprise a worm drive and a barrel lock gear which engage with each other, and which barrel lock gear is affixed to the x-axis barrel.

In one aspect, the present invention comprises a worm drive and a barrel lock gear which are external to the x-axis endpin block.

In one aspect, the present invention comprises a worm drive and a barrel lock gear which are internal to the x-axis endpin block.

In one aspect, the present invention comprises an endpin shaft holder which extends below the front portion of the endpin block body.

In one aspect, the present invention comprises the front of the x-axis endpin block shaped as a sloped front.

In one aspect, the present invention comprises a plurality of holes in the x-axis endpin block for the endpin, which comprise a block straight hole and a block angled hole.

In one aspect, the present invention comprises a block straight hole which is set directly in the endpin shaft holder.

In one aspect, the present invention comprises the endpin inserted in the block straight hole and passes through the full extent of the endpin shaft holder.

In one aspect, the present invention comprises, to use the endpin in an angled position, the x-axis barrel is inserted into the block barrel bore with the block angled hole in alignment with the barrel hole.

In one aspect, the present invention comprises the x-axis barrel, and the x-axis barrel further comprises a plurality of barrel set screw detent holes, which the barrel set screw may be locked or screwed into.

In one aspect, the present invention comprises a plurality of holes in the x-axis endpin block for the endpin, which comprise a block combined hole.

In one aspect, the present invention comprises a plurality of elements for holding the endpin at a desired angle relative to the x-axis endpin block, which comprise a worm drive and a barrel lock gear, and in which the endpin fits in the block combined hole, and the endpin may be adjusted to any of a range of desired angles.

In one aspect, the present invention comprises a plurality of elements for holding the endpin at a desired angle relative to the x-axis endpin block comprise an endpin stopper and an endpin stopper block void, inside the x-axis endpin block, sized to securely hold the endpin stopper; and which endpin stopper is affixed to the endpin top shaft and which endpin stopper has a larger external diameter than the endpin top shaft and a larger external diameter than the barrel hole; and the x-axis barrel may rotate inside the endpin block body until the endpin stopper reaches a rotated angle, at which the endpin stopper and the endpin are positioned in line with the endpin stopper block void; and at that rotated angle, the endpin may then be pushed up, into the endpin block body so that the endpin stopper is securely seated into the endpin stopper block void.

In one aspect, the present invention comprises a desired angle which is 45°.

In one aspect, the present invention comprises securing the endpin in a straight-through position, with the x-axis barrel tightened to the endpin block body with the barrel screw.

In one aspect, the present invention comprises a tailgut-shaft-holder contact surface of the endpin shaft holder which is rounded in exterior profile, and the x-axis endpin block may be rotated about the z-axis of the instrument.

In one aspect, the present invention comprises a block straight hole, a block angled hole, a block barrel bore disposed parallel to the y-axis of the instrument for receiving a y-axis barrel, an endpin shaft holder, an endpin shaft bore, a barrel set screw bore for receiving a barrel set screw, a tailgut wire opening, a tailgut-block contact surface, a tailgut-shaft-holder contact surface, a barrel collar which is placed over a barrel pull threading of the y-axis barrel, and over which barrel collar a barrel pull screw is threaded onto the barrel pull threading.

In one aspect, the present invention comprises a y-axis barrel further which comprises a plurality of holes for receiving the endpin, which plurality of holes comprise a barrel straight hole and a barrel angled hole.

These aspects of the present invention, and others disclosed in the Detailed Description of the Drawings, represent improvements on the current art. This summary is provided to introduce a selection of concepts in a simplified form that are further described below in the Detailed Description of the Drawings. This Summary is not intended to identify key features or essential features of the claimed subject matter, nor is it intended to be used to limit the scope of the claimed subject matter.

BRIEF DESCRIPTION OF THE DRAWINGS

The foregoing summary, as well as the following detailed description of various aspects, is better understood when read in conjunction with the appended drawings. For the purposes of illustration, there is shown in the drawings exemplary aspects; but the presently disclosed subject matter is not limited to the specific methods and instrumentalities disclosed. In the drawings, like reference characters generally refer to the same components or steps of the device throughout the different figures. In the following detailed description, various aspects of the present invention are described with reference to the following drawings, in which.

DETAILED DESCRIPTION OF THE DRAWINGS

The presently disclosed invention is described with specificity to meet statutory requirements. But, the description itself is not intended to limit the scope of this patent. Rather, the claimed invention might also be presented in other aspects, to include different steps or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

In the following description, numerous specific details are set forth to provide a thorough understanding of the invention. But, the present invention may be practiced without these specific details. Structures and techniques that would be known to one of ordinary skill in the art have not been shown in detail, in order not to obscure the invention. Referring to the figures, it is possible to see the various major elements constituting the methods and systems of the present invention.

The present subject matter discloses aspects of improved endpin block apparatus for use on and support of stringed instruments. At a high level of overview, the endpin block apparatus of the present invention are made so that the endpin block apparatus may be installed on a stringed instrument with little or no modification of the instrument's body, and the endpin block apparatus allows a musician using an instrument with the endpin block apparatus greater choice of the location and angles of the endpin relative to the instrument, providing better support of the instrument and improved range of positions which the musician may employ while playing the instrument.

In the following descriptions of the inventive apparatus of the present disclosure, reference is made to structures and components of an inventive y-axis endpin block 100 and of an inventive x-axis endpin block 200; further description of such structures and components is in the discussion of the figures below.

Figure 1A:
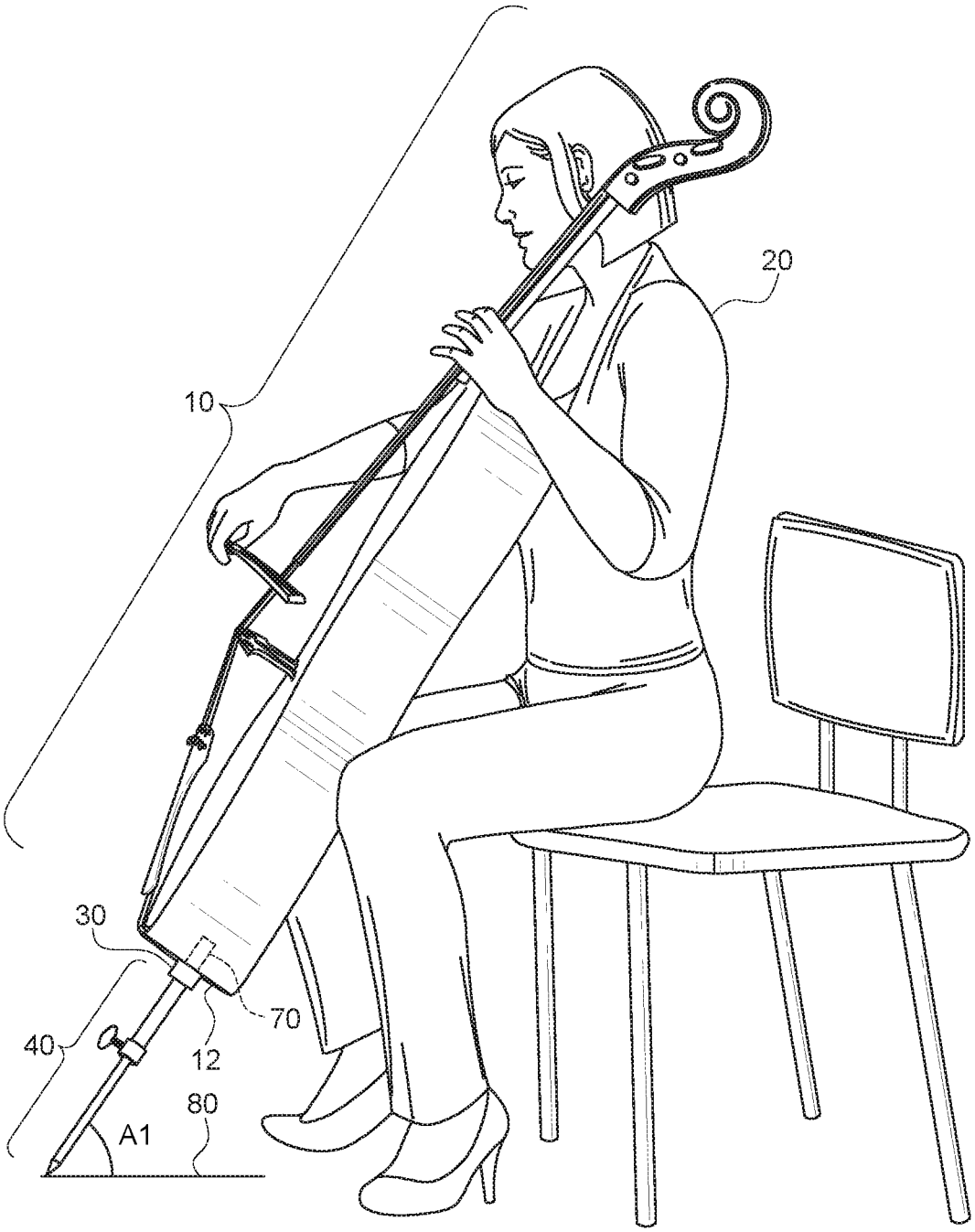
FIG. 1A shows a perspective view of a musician playing a stringed instrument (here, a cello) with a prior-art traditional straight endpin relative to the instrument long axis.
Figure 1B:
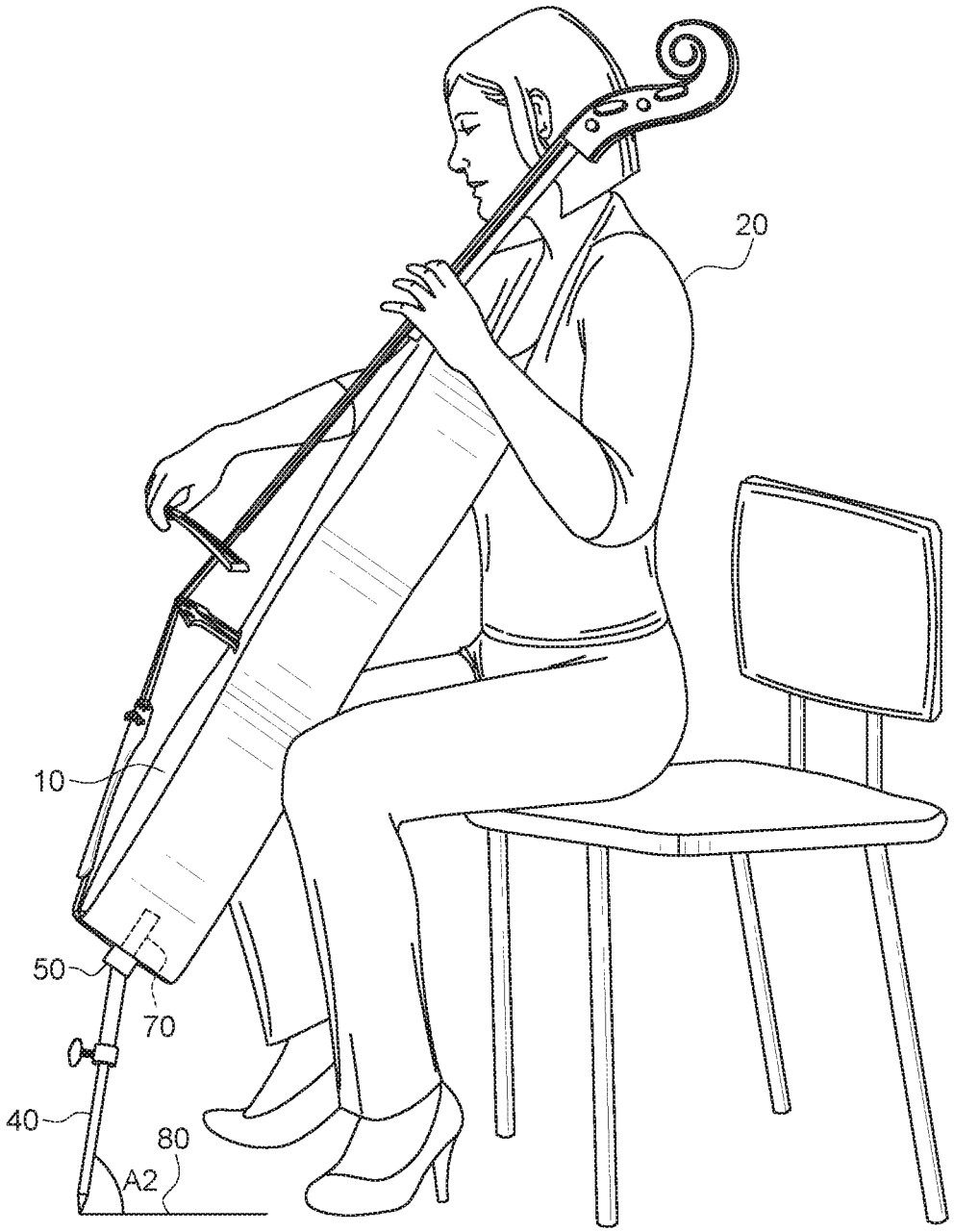
FIG. 1B shows a perspective view of a musician playing a stringed instrument (here, a cello) with a prior-art angled endpin.

FIG.1A and FIG. 1B illustrate prior-art endpin supports for a large stringed instrument 10. With a traditional endpin holder 30, the endpin 40 is aligned with the z-axis of the instrument (refer to FIG. 2A for a reference set of axes used throughout the present disclosure). The endpin 40 emerges from (or can be pushed up into, for storage and transport) a hole in the instrument 10 in the lower rib area 12 of the instrument 10 and into the endpin sleeve 70, and the endpin holder 30 braces the endpin 40 at that hole. The endpin 40 can only be straight out of the endpin holder 30. This severely limits the range of angles the musician 20 can have the instrument 10 at, while playing. The endpin 40 is adjustable for length, but as it must emerge from the endpin holder 30 aligned with the z-axis of the instrument 10, it can only contact the floor 80 at a single angle A1 for a particular length of the endpin and height of the musician 20. This limits the range of motion of the musician 20, and may lead to discomfort while playing, to repetitive stress injuries for the musician 20, and to difficulty in moving and playing as the musician 20 desires, due to the need to support the weight of the instrument 10 using the musician's 20 knees, shoulder, legs, and hand.

With reference to FIG. 1B, a prior-art angled endpin holder 50 is depicted with an exemplary instrument 10 played by the musician 20. The angled endpin holder 50 is braced to the instrument 10 at the same hole in the center of the instrument 10 at the lower rib area 12, but unlike the endpin holder 30, the angled endpin holder 50 allows the endpin 40 to emerge from the angled endpin holder 50 at an angle relative to the z-axis of the instrument 10. Accordingly, the endpin 40 contacts the floor 80 at an angle A2 that is greater than angle A1 but less than 90° relative to the floor 80. While this presents an improvement over the traditional endpin holder 30, it still poses the same problems for the musician 20: incomplete support of the instrument 10, an inability to move freely while playing which limits musical expression, and repetitive stress injuries from the need to support the weight of a heavy instrument 10 while playing.

Figure 2A:
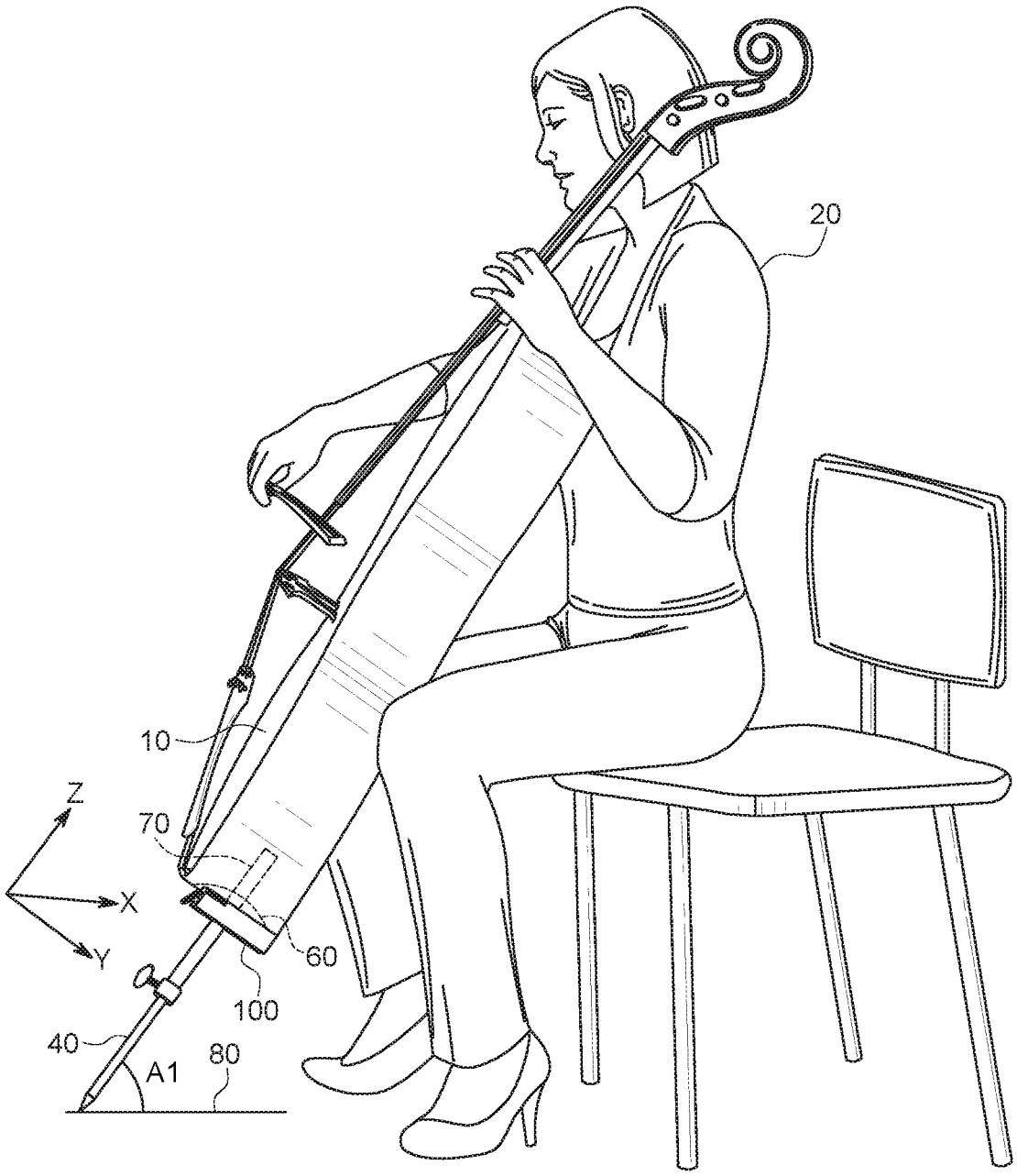
FIG. 2A shows a perspective view of a musician playing a stringed instrument (here, a cello) with an exemplary inventive endpin block apparatus, with the endpin in a straight position relative to the instrument long axis.

With reference to FIG. 2A, a y-axis endpin block 100 is shown on an exemplary instrument 10. FIG. 2A presents the set of x, y, and z axes referred to throughout the present disclosure. In FIG. 2A, the endpin 40 is braced in the y-axis endpin block 100 straight out of the hole in the lower rib area 12 of the instrument 10, using the same endpin sleeve 70, and thus contacts the floor 80 at the same angle A1 as with the traditional endpin holder 30 shown in FIG. 1A (for the same length of endpin 40 and height of musician 20). FIG. 2A also shows the reinforcing block 60 that is a traditional part of the instrument 10, and which further supports the endpin holder 30 and endpin 40 inside the instrument 10. In this manner, the y-axis endpin block 100 of the present invention may be used to provide the exact same support of an instrument 10 using an endpin 40 that any musician 20 is accustomed to.

Figure 2B:
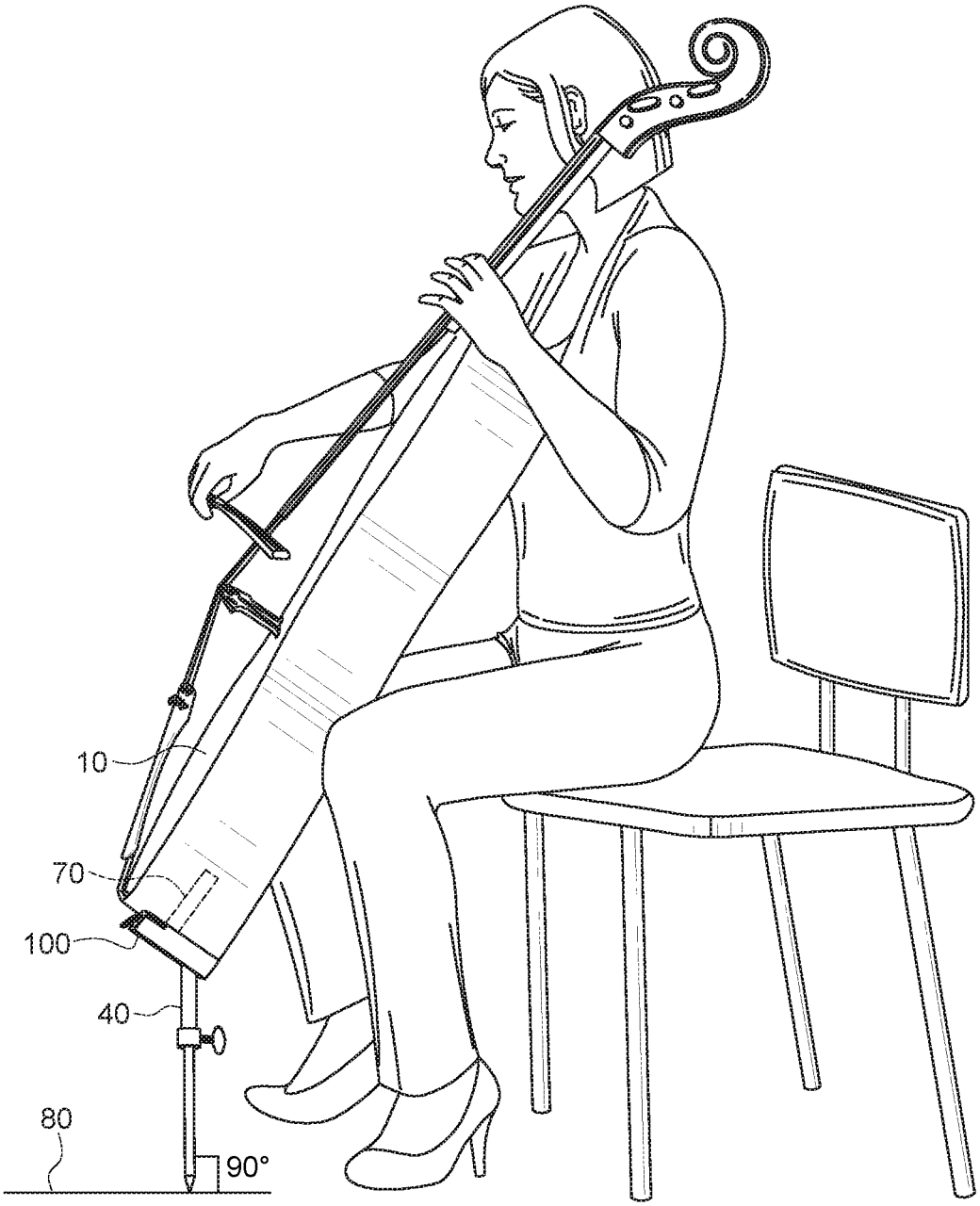
FIG. 2B shows a perspective view of a musician playing a stringed instrument (here, a cello) with an exemplary inventive endpin block apparatus, with the endpin in an angled position, and offset from the centered attachment hole of the endpin block apparatus.

FIG. 2B depicts one of the innovations that improves the experience of the musician 20 in playing or using an instrument 10 that has the inventive y-axis endpin block 100. The endpin 40 may be affixed to the y-axis endpin block 100 at an angle relative to the z-axis of the instrument 10, while the endpin 40 remains in the y-z plane as defined by the set of axes, and the endpin 40 may be offset from the center of the instrument 10 (where the reinforcing block 60 and the endpin sleeve 70 are), and instead is attached to the y-axis endpin block 100 farther towards the rear of the y-axis endpin block 100 and the rear of the instrument 10. This allows the endpin 40 to contact the floor 80 farther towards the feet of the musician 20 at an angle that is approximately 90°, as marked in FIG. 2B. This placement of the endpin 40 in and from the y-axis endpin block 100 allows the endpin 40 to bear far more of the weight of the instrument 10, because the endpin 40 is much closer to being directly under the center of mass of the instrument 10. By bearing more of the weight of the instrument 10, the endpin 40 in the inventive y-axis endpin block 100 allows the musician 20 to bear less of the weight of the instrument 10, and therefore frees up the musician to move more while playing and express herself or himself musically more fully, and lowers the risk of repetitive stress injuries for the musician 20. It has been found advantageous to have the endpin 40 be approximately perpendicular to the floor 80 or ground, so that the endpin 40 meets the floor 80 with most of the weight of the instrument 10 directed down so as to maximize the frictive forces between the floor 80 and the endpin 40 and therefore reduce the risk of the endpin 40 sliding along the floor 80, as opposed to having a significant component of the force directed sideways, which would reduce the frictive forces between the floor 80 and the endpin 40 and increase the risk of the endpin 40 sliding and the instrument 10 being damaged.

Figure 2C:
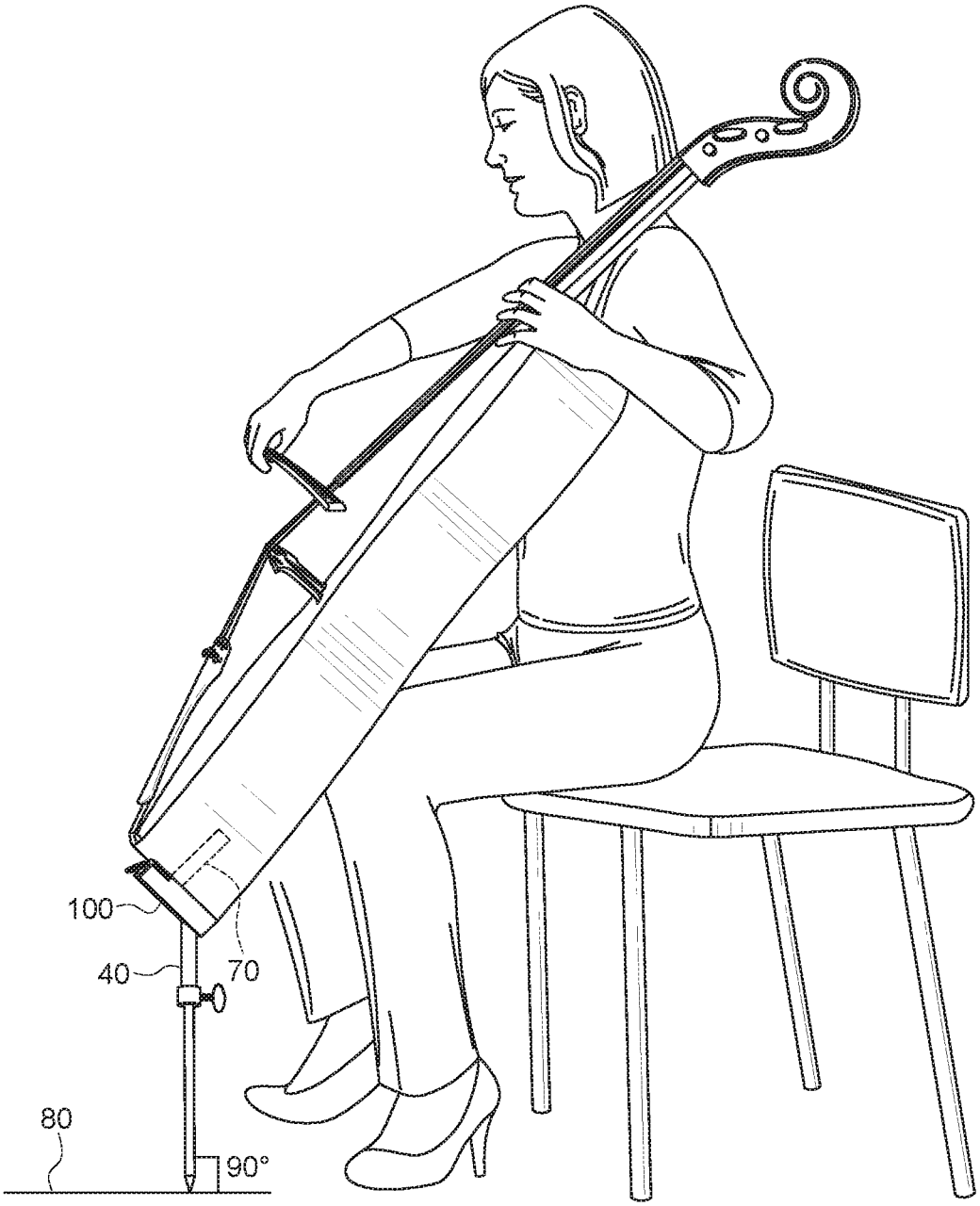
FIG. 2C shows a perspective view of a musician playing a stringed instrument (here, a cello) with an exemplary inventive endpin block apparatus, with the endpin in a sharply angled position, and offset from the centered attachment hole of the endpin block apparatus.
Figure 3:
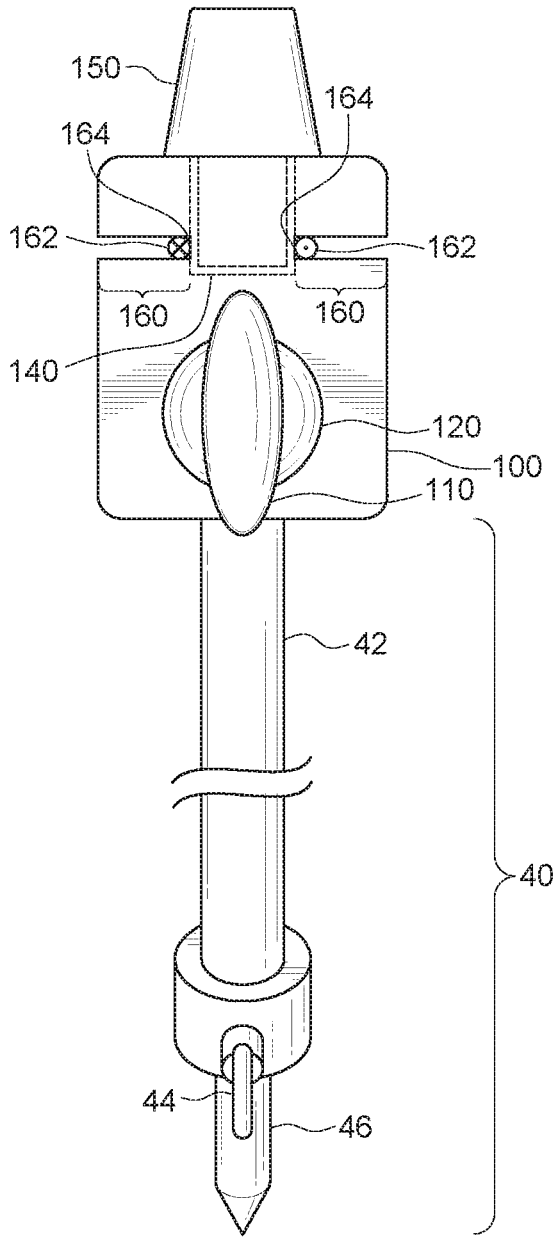
FIG. 3 shows a front elevation view of an exemplary endpin block apparatus of the present invention.
Figure 4:
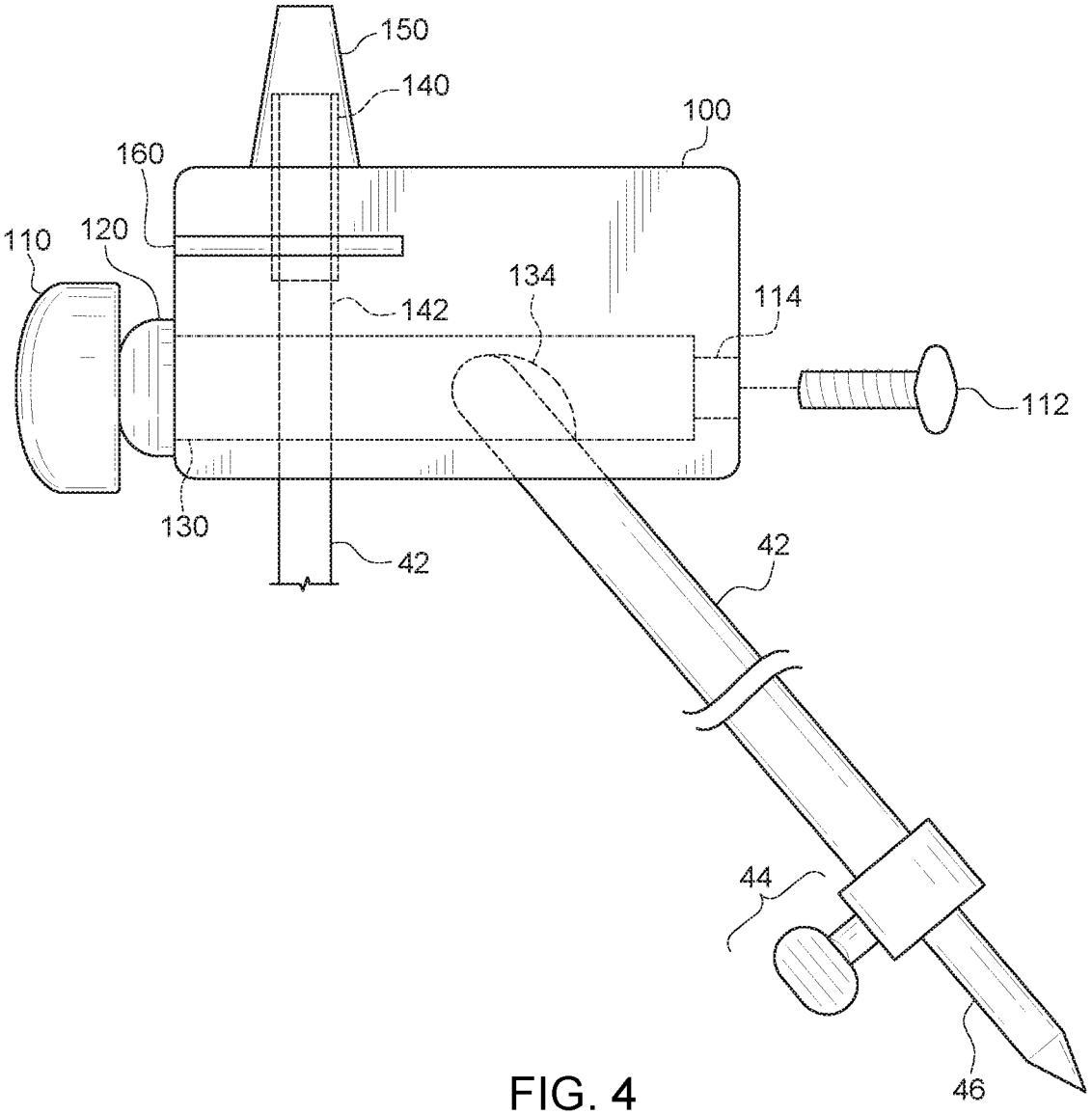
FIG. 4 shows a side elevation view of an exemplary endpin block apparatus of the present invention.
Figure 5:
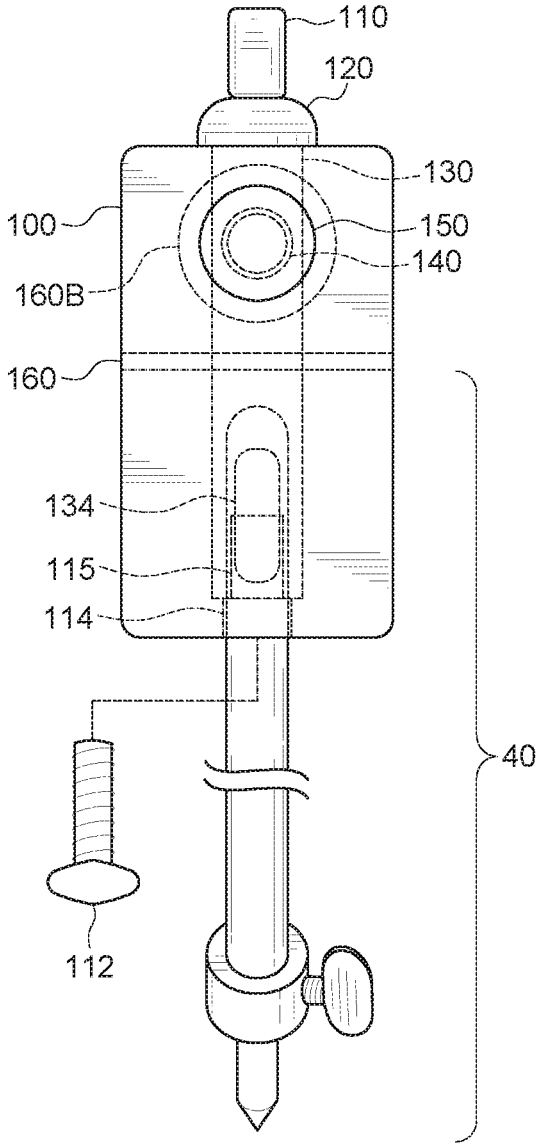
FIG. 5 shows a top elevation view of an exemplary endpin block apparatus of the present invention.
Figure 6:
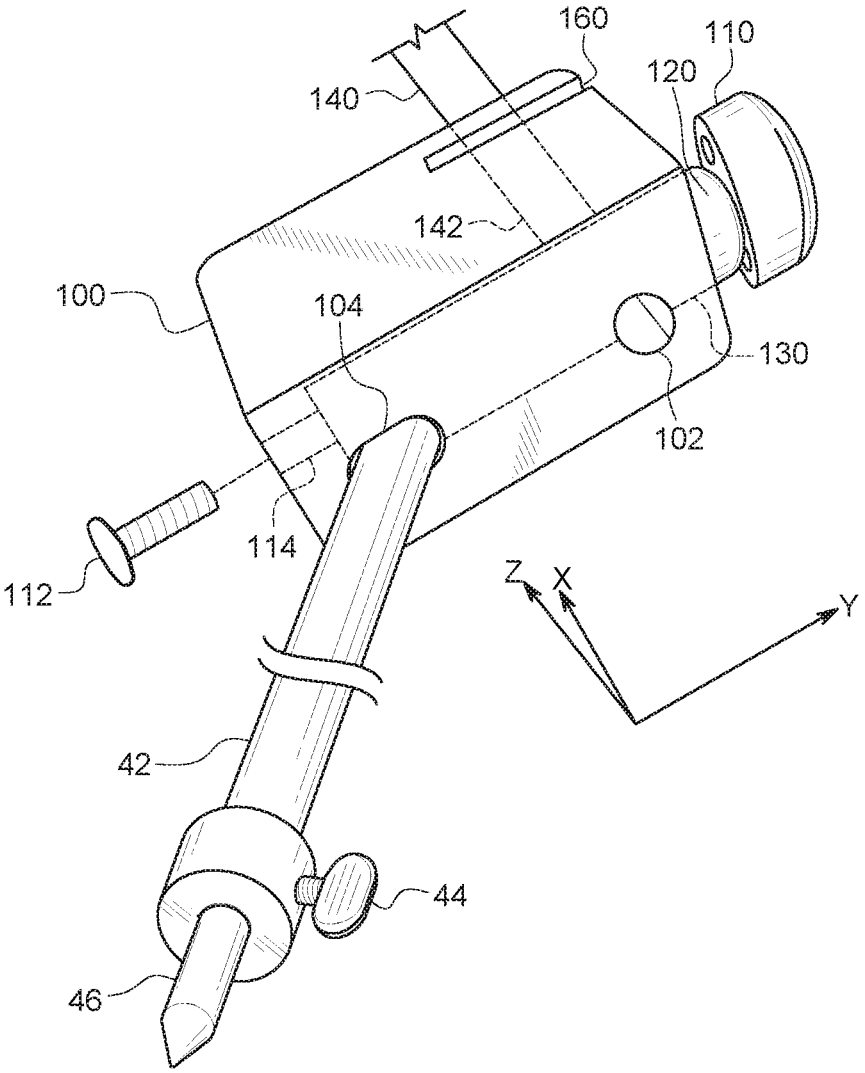
FIG. 6 shows a perspective view, from the side and underneath, of an exemplary endpin block apparatus of the present invention.
Figure 7:
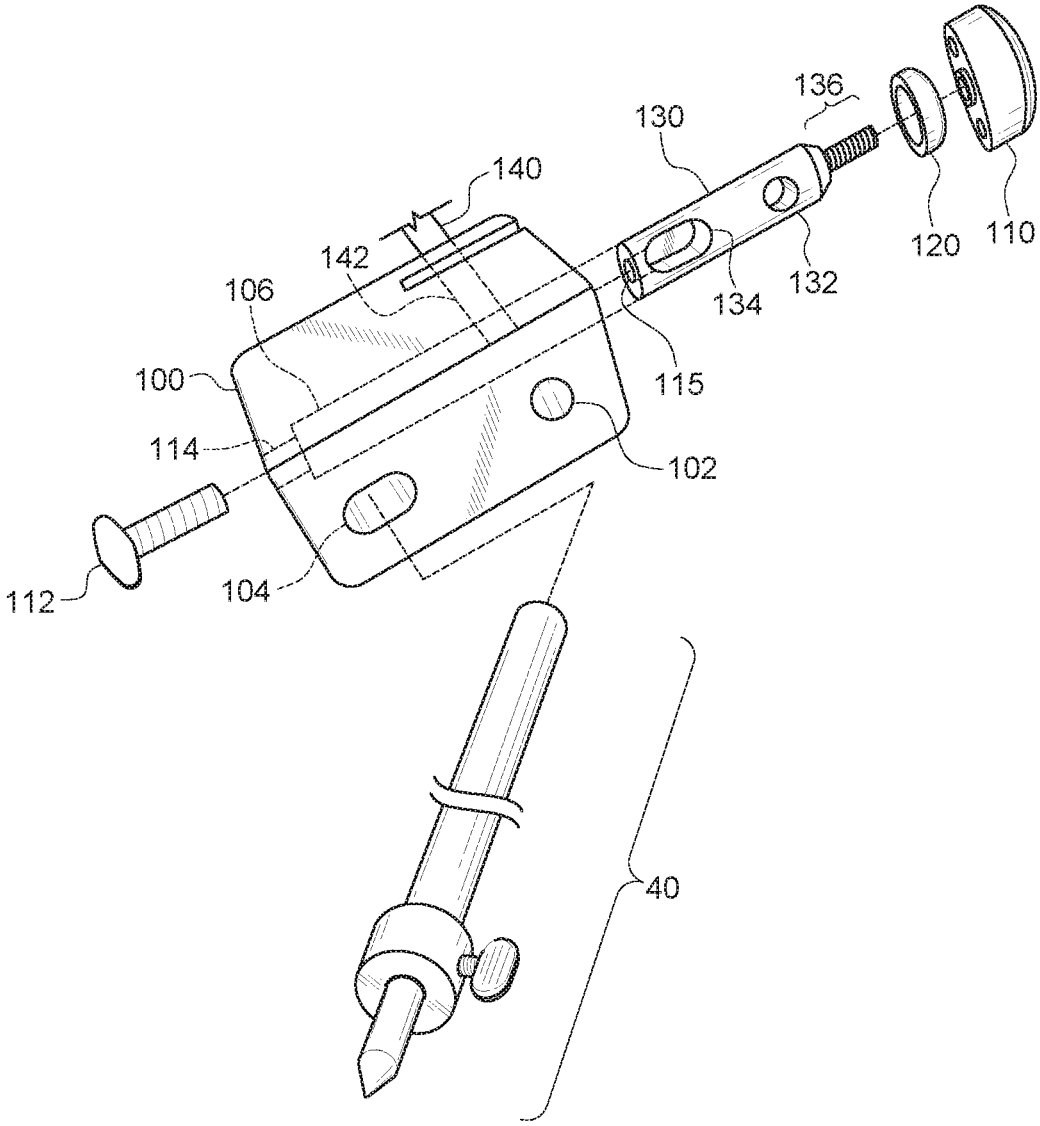
FIG. 7 shows an exploded perspective view, from the side and underneath, of an exemplary endpin block apparatus of the present invention.
Figure 8:
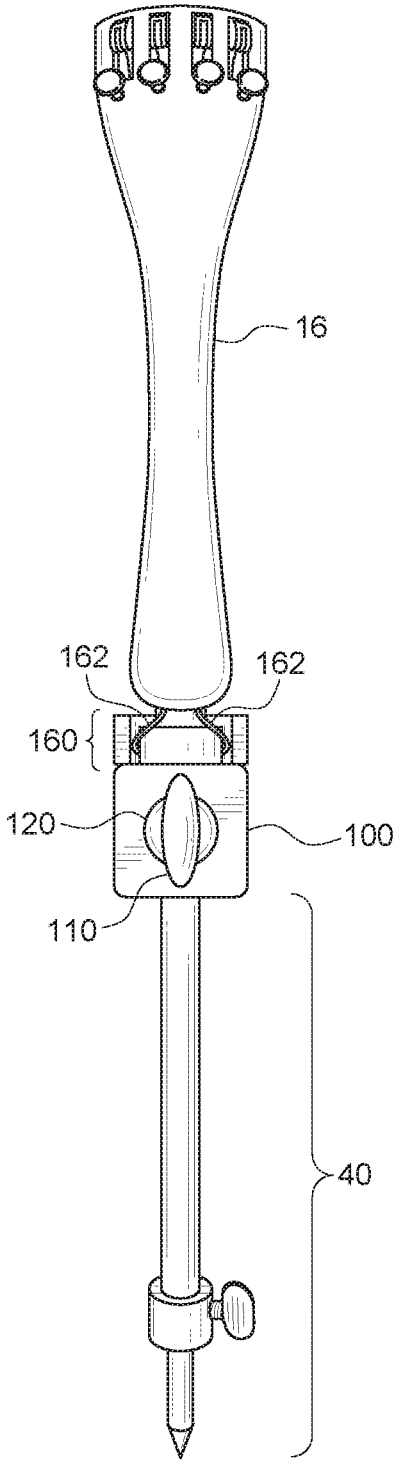
FIG. 8 shows a front elevation view of an exemplary endpin block apparatus of the present invention, including the tail piece and tail gut of the instrument but no other components of the instrument, to depict their connection to the exemplary endpin block apparatus.
Figure 9:
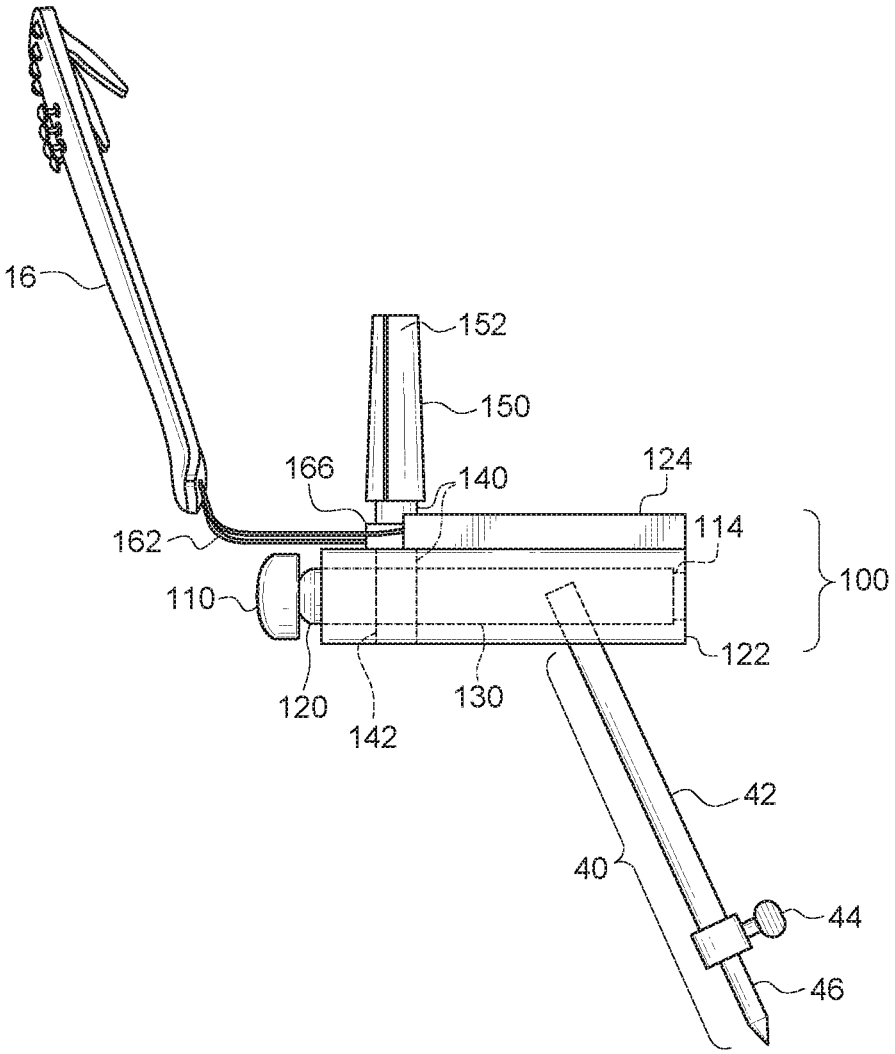
FIG. 9 shows a side elevation view of an exemplary endpin block apparatus of the present invention, including the tail piece and tail gut of the instrument but no other components of the instrument, to depict their connection to the exemplary endpin block apparatus.
Figure 10:
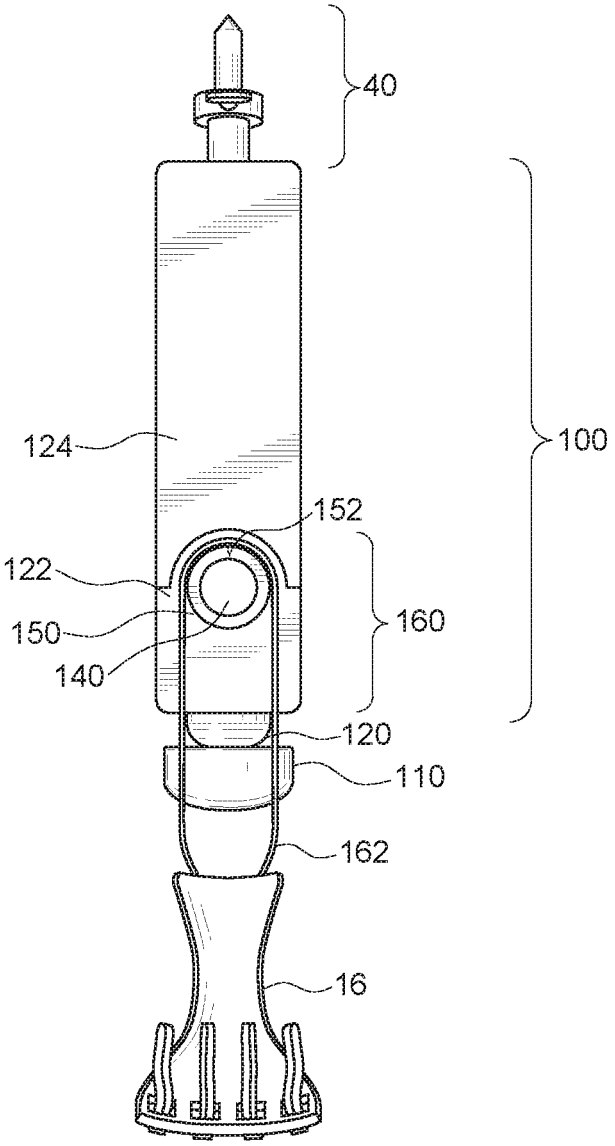
FIG. 10 shows a top elevation view of an exemplary endpin block apparatus of the present invention, including the tail piece and tail gut of the instrument but no other components of the instrument, to depict their connection to the exemplary endpin block apparatus.
Figure 11:
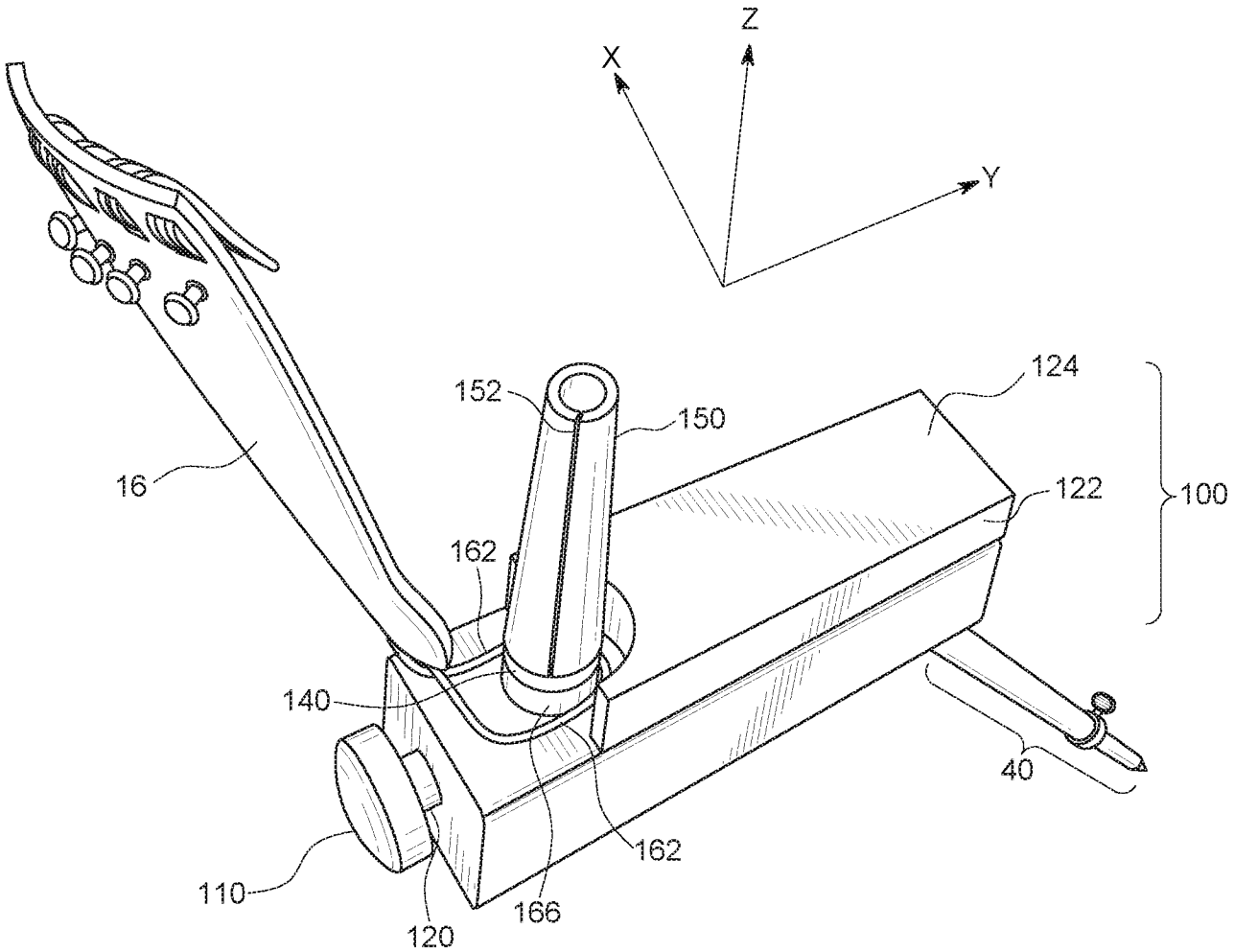
FIG. 11 shows a perspective view, from the top, side, and front, of an exemplary endpin block apparatus of the present invention, including the tail piece and tail gut of the instrument but no other components of the instrument, to depict their connection to the exemplary endpin block apparatus.
Figure 12:
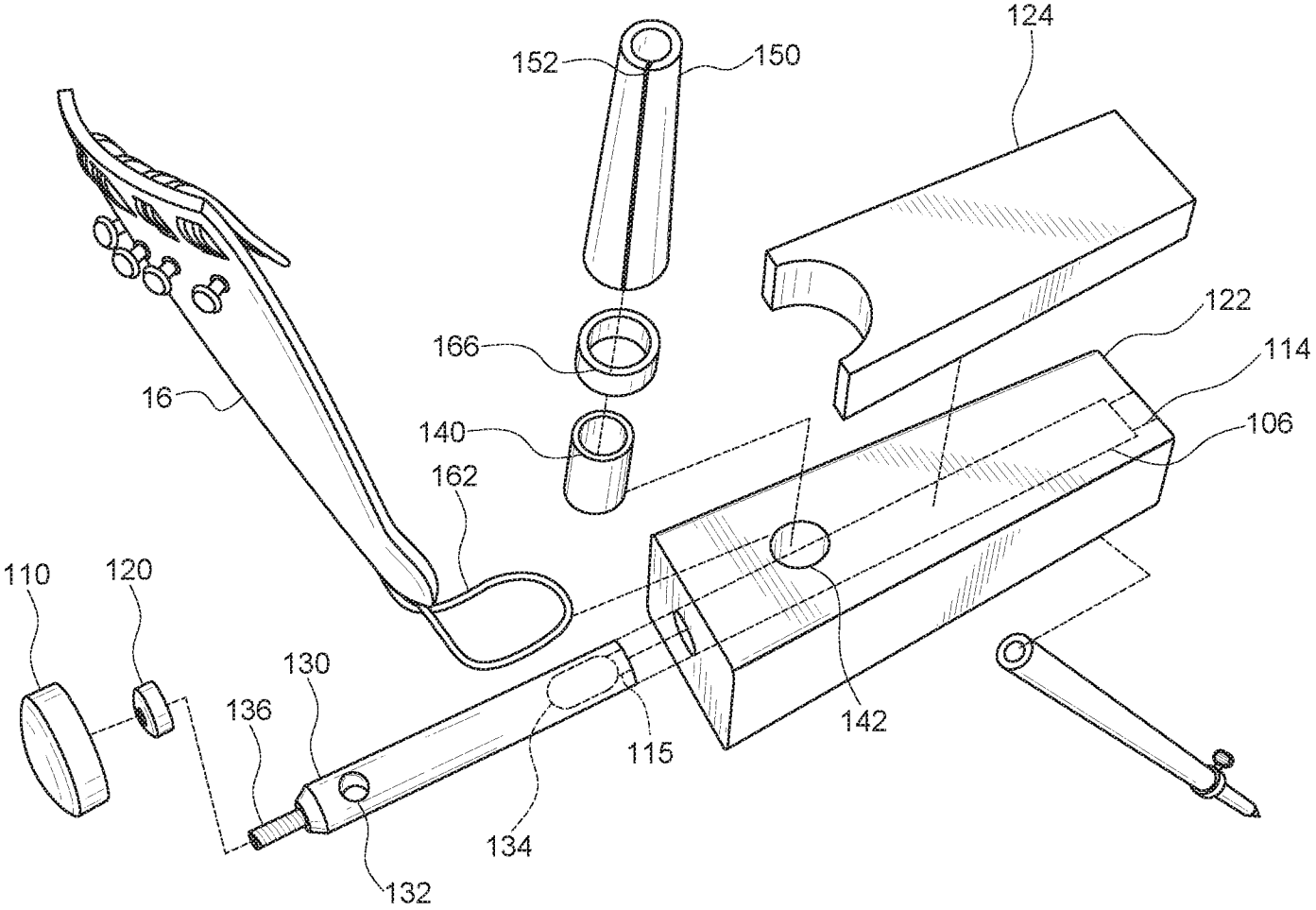
FIG. 12 shows an exploded perspective view, from the top, side, and front, of an exemplary endpin block apparatus of the present invention, including the tail piece and tail gut of the instrument but no other components of the instrument, to depict their connection to the exemplary endpin block apparatus.
Figure 13:
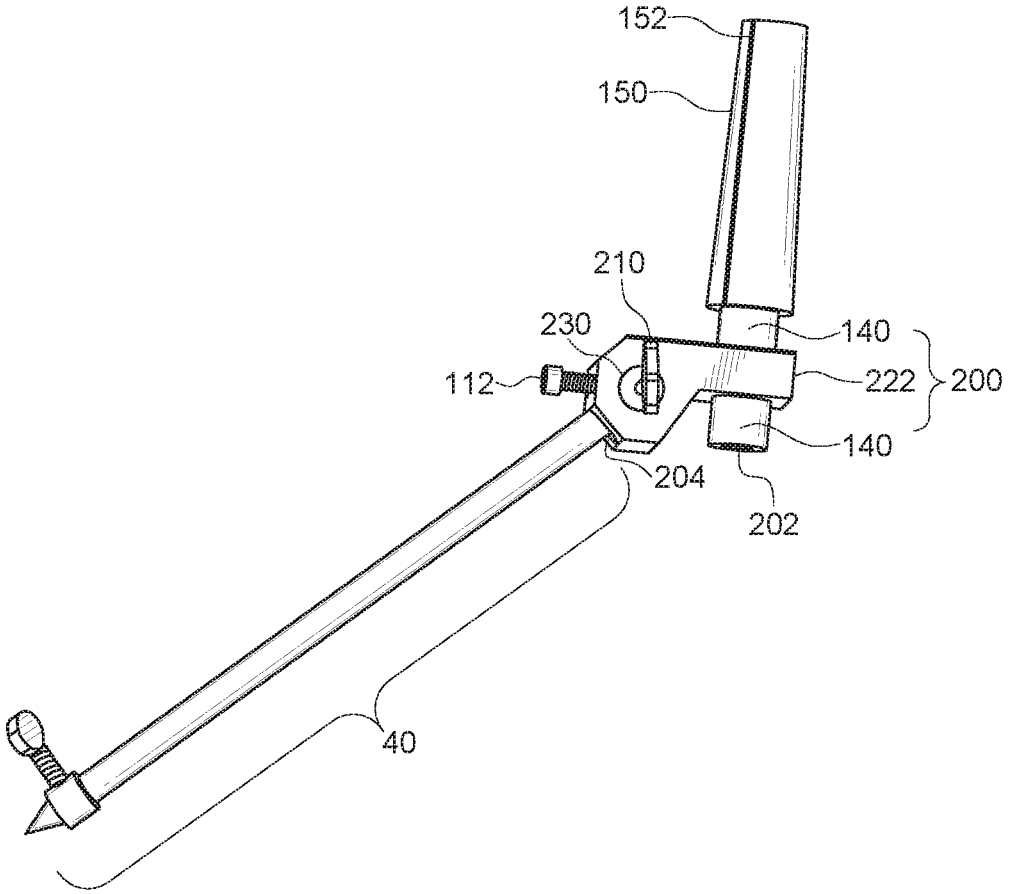
FIG. 13 shows a side perspective view of an exemplary endpin block apparatus of the present invention.
Figure 14:
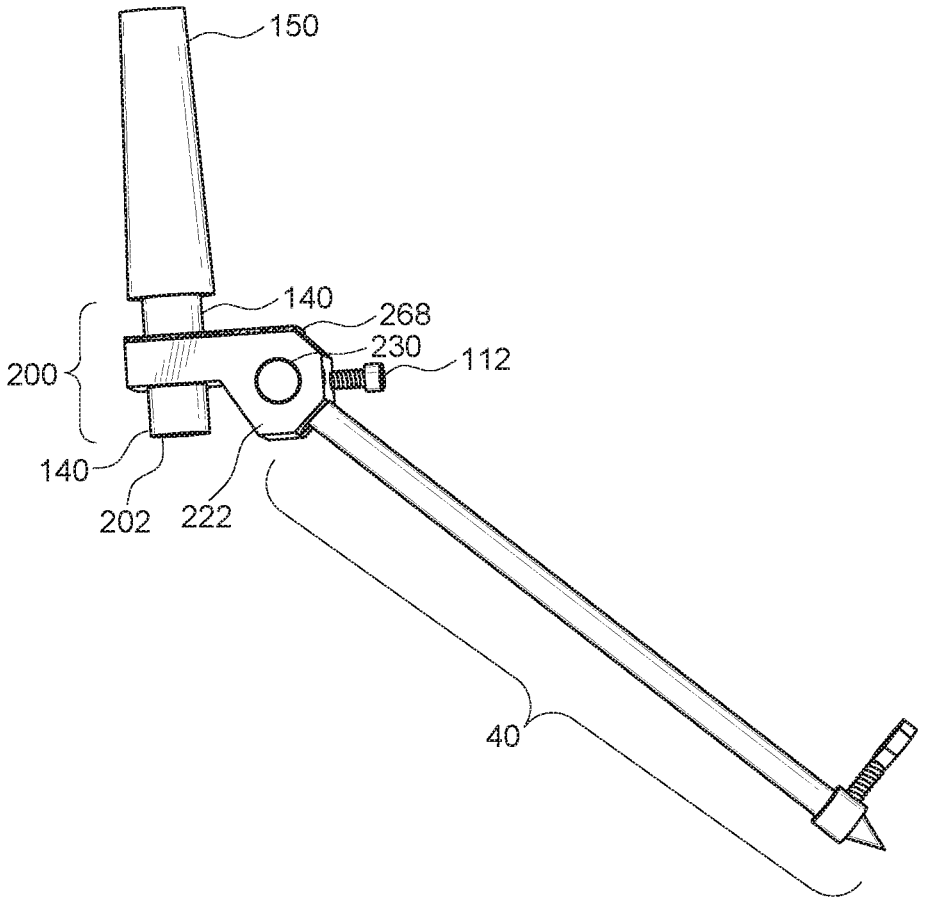
FIG. 14 shows a side perspective view of the exemplary endpin block apparatus of the present invention of FIG. 13, from the opposite side of that presented in FIG. 13.
Figure 15:
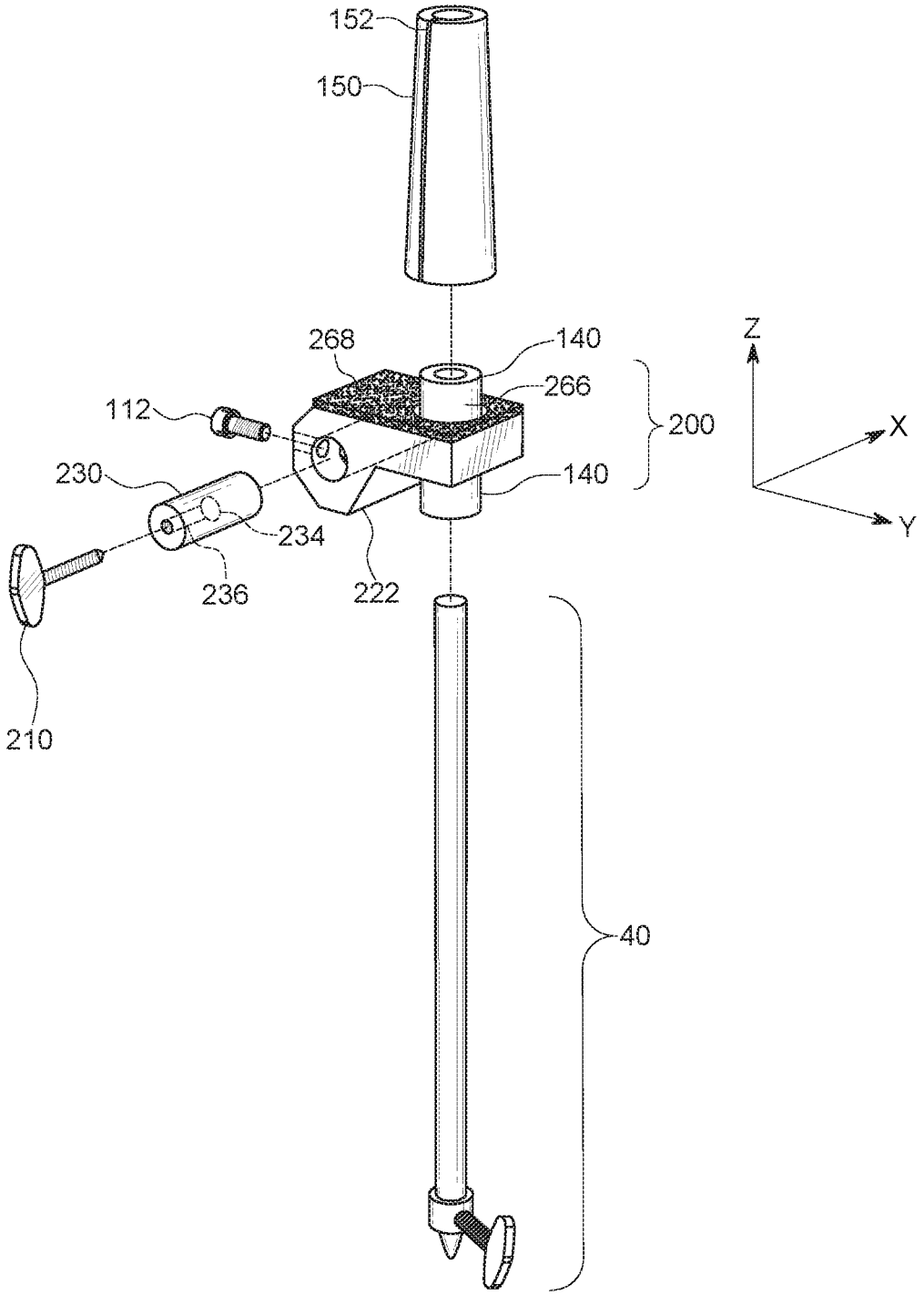
FIG. 15 shows an exploded front perspective view of the exemplary endpin block apparatus of the present invention of FIG. 13.
Figure 16:
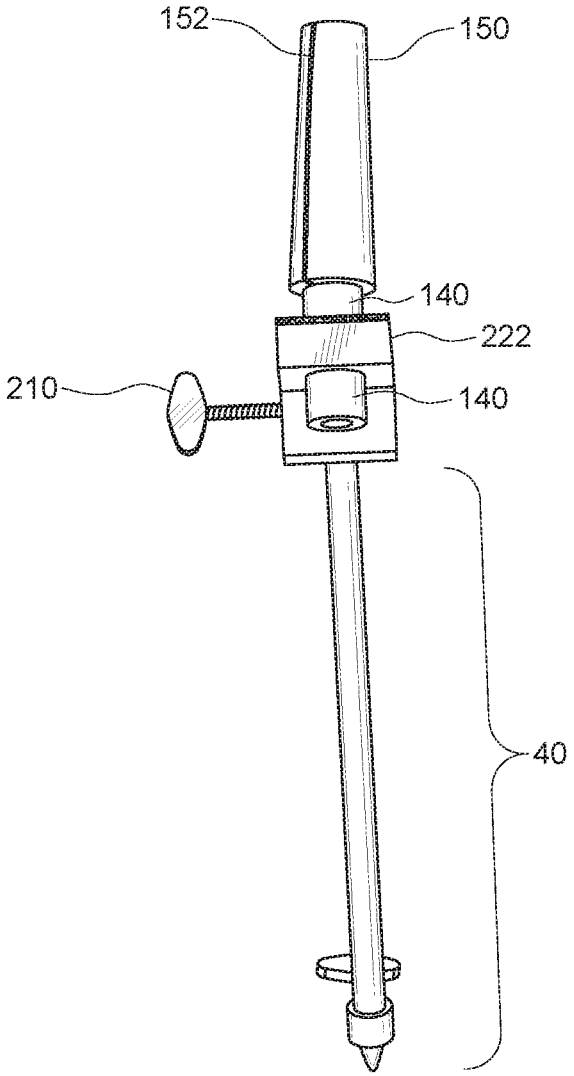
FIG. 16 shows a front perspective view of the exemplary endpin block apparatus of the present invention of FIG. 13.
Figure 17:
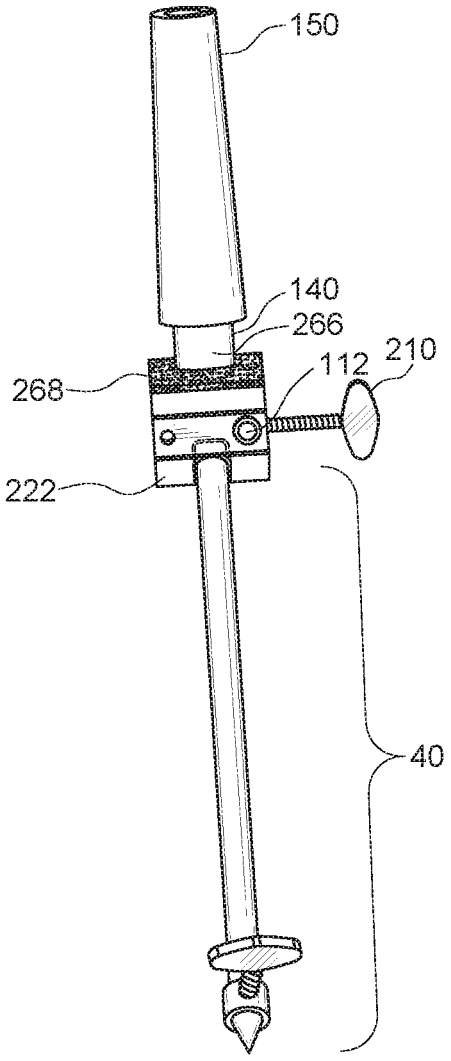
FIG. 17 shows a rear perspective view of the exemplary endpin block apparatus of the present invention of FIG. 13.
Figure 18:
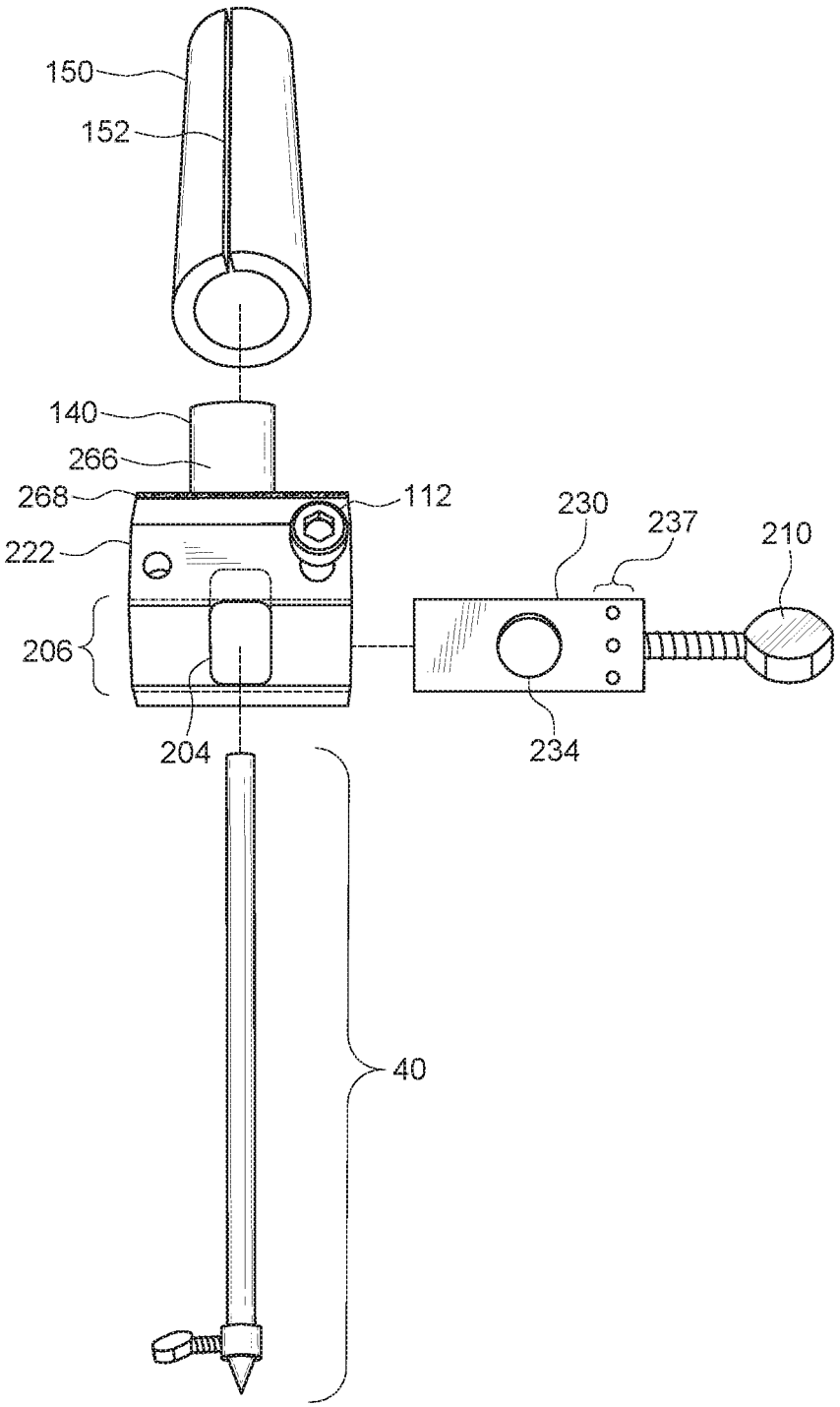
FIG. 18 shows an exploded rear perspective view of the exemplary endpin block apparatus of the present invention of FIG. 13.

As shown in FIG. 2C, for a musician 20 of any given height—the musician 20 shown in FIG. 2C is shorter than the musician 20 shown in FIG. 2B—the endpin 40 may be adjusted in height to allow the instrument 10 to be held by the musician 20 at a location that is comfortable, while still allowing the endpin 40 to meet the floor 80 at an angle that is approximately 90°, while having the endpin 40 braced in the y-axis endpin block 100 at an angle relative to the z-axis of the instrument 10.

With reference to FIG. 3, FIG. 4, FIG. 5, FIG. 6, and FIG. 7, an aspect of the improved endpin block apparatus comprising a y-axis endpin block 100 of the present invention is shown. The y-axis endpin block 100 comprises a block straight hole 102, a block angled hole 104, a block barrel bore 106 disposed parallel to the y-axis of the instrument 10 for receiving a y-axis barrel 130, an endpin shaft holder 140, an endpin shaft bore 142, a barrel set screw bore 114 for receiving a barrel set screw 112. The y-axis endpin block 100 further comprises a tailgut wire opening 160 wherein the tailgut 162 is received, a tailgut-block contact surface 164, and a tailgut-shaft-holder contact surface 166. The apparatus further comprises a barrel collar 120 which is placed over a barrel pull threading 136 of the y-axis barrel 130, and over which barrel collar 120 a barrel pull screw 110 is threaded onto the barrel pull threading 136, which allows the y-axis barrel 130 to be tightened against the surface of the y-axis endpin block 100, with the barrel collar 120 making contact with the y-axis endpin block 100 and holding the y-axis barrel 130 firmly against the y-axis endpin block 100. With the endpin 40 placed in the y-axis endpin block 100 and the y-axis barrel 130, as described below, turning the barrel pull screw 110 on the barrel pull threading 136 pulls the endpin 40 against the interior surfaces of the y-axis endpin block 100 and the y-axis barrel 130, and pulls the barrel collar 120 against the exterior surface of the y-axis endpin block 100, such that those component exert pressure against one another, and hold each other in place relative to each other.

The y-axis barrel 130—so-called because it is parallel to the y-axis of the instrument 10—further comprises a plurality of holes for receiving an endpin 40. It has been found advantageous to have the plurality of holes comprise a barrel straight hole 132 and a barrel angled hole 134. When the y-axis barrel 130 is disposed inside the y-axis endpin block 100 in the block barrel bore 106, which disposition is shown in FIGS. 4-7, the block straight hole 102 and the barrel straight hole 132 align under the hole in the instrument 10, in the lower rib area 12, whereupon the endpin 40 may be used as with a traditional endpin holder 30, with the endpin 40 being inserted inside the instrument 10 through the endpin sleeve 70 for transport and storage, and extended out of the instrument 10 for use (in performance or practice with the instrument 10 by the musician 20, during which use some extent of the endpin 40 may remain in the interior of the instrument 10, depending on the musician's 20 selected length of the endpin 40). When the endpin 40 is placed in this manner, it may pass through the endpin shaft bore 142, which traverses the y-axis endpin block 100 parallel to the z-axis of the instrument 10 and aligns with the block straight hole 102 and the barrel straight hole 132, and the endpin 40 may pass through the endpin shaft holder 140, which endpin shaft holder 140 is disposed to seat a collar 150, which collar 150 is inserted into the instrument 10 to brace and secure the y-axis endpin block 100 to the instrument 10.

The collar 150 comprises, it has been found advantageous, a conical hollow piece that is sized for insertion into an instrument 10, and which further comprises a collar slit 152 which allows the collar 150 to be expanded and compressed against the interior surface of the instrument 10, in particular against the interior surface of the opening in the reinforcing block 60, bracing the y-axis endpin block 100 to the instrument 10.

The block barrel bore 106 comprises a void of size and shape to fit the y-axis barrel 130 and is disposed in the y-axis endpin block 100 parallel to the y-axis of the instrument 10 and nearly as long as the y-axis endpin block 100 but advantageously not as long as y-axis endpin block 100. It will be understood by one of skill in the art that the block barrel bore 106 may have a guide fin protrude from it, and a matching guide slot cut into the y-axis endpin block 100 surrounding the block barrel bore 106, so that the y-axis barrel 130 may only be inserted into the y-axis endpin block 100 properly aligned, so that the block straight hole 102 and the barrel straight hole 132 allow the endpin 40 to pass through the y-axis endpin block 100 and the y-axis barrel 130, through the endpin shaft holder 140, and through the collar 150 into the instrument 10. Similarly, the y-axis barrel 130 may have a guide slot cut into it, and the y-axis endpin block 100 may have a matching guide fin that extends into the space of the block barrel bore 106, so that the y-axis barrel 130 may be inserted only in proper alignment, as described above.

Alternatively, the endpin 40 may be removed from the block straight hole 102 and the barrel straight hole 132 and placed through the block angled hole 104 and into the barrel angled hole 134. In such uses, the endpin 40 does not extend into the instrument 10, because the barrel angled hole 134 does not traverse through the y-axis barrel 130: the y-axis barrel 130 is solid at the top portion of the y-axis barrel 130, above the barrel angled hole 134. Because the barrel angled hole 134 and block angled hole 104 are disposed towards the back of the y-axis endpin block 100 (that is, towards the back of the instrument 10, which is the face of the instrument closest to the musician 20, and is the face opposite the front of the instrument, where the strings, bridge, f-shaped holes, and tailpiece 16 are disposed), the endpin 40, in this use, is connected to the instrument 10 at an offset from the center of the instrument 10, and accordingly can contact the floor 80 closer to the feet of the musician 20 and at an angle that is closer to 90° relative to a traditional endpin 40.

By tightening the barrel pull screw 110 on the barrel pull threading 136, and the barrel set screw 112 (in the barrel set screw bore 114, against the end of the y-axis barrel 130 opposite the barrel pull threading 136), the y-axis barrel 130 is secured in place inside the y-axis endpin block 100, and the endpin 40 is held firmly against the interior surfaces of the y-axis endpin block 100 and the y-axis barrel 130, at the angle chosen by the musician 20, because the barrel angled hole 134 is elongated, parallel to the y-axis, inside the y-axis barrel 130. In this way, as will be understood by one of skill in the art, a musician 20 may select and adjust the exact placement of the endpin 40 inside the y-axis barrel 130 and thus the angle the endpin 40 forms in contact with the floor 80 and the angle of the instrument 10, which angle of the endpin 40 may be secured inside the y-axis barrel 130 by passing the barrel set screw 112 through the barrel set screw bore 114 and into a barrel set screw threaded receiver 115. By selecting a desired length of the endpin 40, which is done as with any traditional endpin 40, using an endpin screw 44 to loosen and tighten an endpin top shaft 42 relative to an endpin bottom shaft 46, the musician 20 may customize where and how the instrument 10 fits and sits on the musician 20.

The y-axis endpin block 100 has disposed in it, as an opening or channel, the tailgut wire opening 160. This is the opening through which the tailgut 162 is passed when assembling the y-axis endpin block 100 to the instrument 10. The tailgut 162 makes contact with the y-axis endpin block 100 at the tailgut-block contact surface 164, which tailgut-block contact surface 164 may comprise part of the y-axis endpin block 100 material, or may comprise the surface of the endpin shaft holder 140. The tailgut 162 is under tension, attached at both ends to the tailpiece 16, and exerts pressure on the tailgut-block contact surface 164, which helps to keep the y-axis endpin block 100 from moving relative to the instrument 10. If the tailgut wire opening 160 is rounded in interior profile, as shown by tailgut wire opening 160B in FIG. 5, the y-axis endpin block 100 may be able to rotate in the x-y plane, around the z-axis, which may be advantageous if the musician 20 desires an offset of the endpin 40 relative to the y-z plane of the instrument. If the tailgut wire opening 160 is not rounded in interior profile, such as a square interior shape as shown by tailgut wire opening 160*a* in FIG. 5, the y-axis endpin block 100 will be difficult to rotate in the x-y plane, around the z-axis, preventing the y-axis endpin block 100 from shifting.

Where the tailgut wire opening 160 is rounded in interior profile, any aspect of the present invention may be rotated about the z-axis of the instrument 10 when it is being assembled to the instrument 10, and before the tailgut 162 is secured to the apparatus of the present invention and the tailpiece 16, which puts the apparatus under tension and prevents it from further rotating about the z-axis. This feature of the present invention allows for rotation of the endpin 40 exit angle in a plane that is perpendicular to the x-y plane and rotated around the z-axis, which under the prior art is possible only with significant risks of damage to the instrument 10. This advantage of the present invention exists with any aspect of the present invention wherein the tailgut wire opening 160 is rounded in interior profile, such as in the y-axis endpin block 100 described herein.

Another advantage of the present invention is that the y-axis endpin block 100 and the x-axis endpin block 200 present a significantly larger area of support from the top of the y-axis endpin block 100 or the top of the x-axis endpin block 200 (described below) in contact with the underside of the instrument 10, in the lower rib area 12, than with a prior-art endpin holder 30 or angled endpin holder 50, which typically extend only about 0.5" from the hole in the lower rib area 12 of the instrument 10. In contrast, the apparatus of the present invention—a y-axis endpin block 100 or a x-axis endpin block 200—may extend approximately 3", 4", 5", or more from the hole in the lower rib area 12 of the instrument 10, which means that to provide the same amount of support of weight, with 6, 8, or 10 times the moment arm providing an equivalent amount of torque, the force exerted on the lower rib area 12 at the end of the may be reduced by a factor of 6, 8, 10, or more, resulting in a significant reduction in stress on the instrument 10 and accordingly a far lower risk of damage to the instrument 10. Moreover, because the surface area of the y-axis endpin block 100 or of the x-axis endpin block 200 in contact with the instrument is far larger than the surface area of a endpin holder 30 or of a angled endpin holder 50 in contact with the instrument 10, the pressure on the instrument 10 is reduced, which also lowers the risk of damage to the instrument 10. These innovations represent significant improvements over the prior art.

With reference to FIGS. 8-12, another aspect of the y-axis endpin block 100 of the present invention is shown. This aspect of the y-axis endpin block 100 is similar to the one of FIGS. 3-7, with a few differences. In this aspect, the tailgut wire opening 160 may be a large void at the top and front of the y-axis endpin block 100, rather than a channel that is enclosed at the top and bottom of the tailgut wire opening 160 by the material of the y-axis endpin block 100. In the aspect of FIGS. 8-12, the material of the y-axis endpin block 100 is removed, or never manufactured, so that there is no material of the y-axis endpin block 100 above the tailgut wire opening 160, that is, above the space where the tailgut 162 sits. The tailgut 162 is still under tension, due to its attachment at both ends to the tailpiece 16, and is constrained above by the lower rib area 12 of the underside of the instrument 10, against which the top of the y-axis endpin block 100 is securely seated.

The tailgut 162 may contact the endpin shaft holder 140 directly, as the tailgut-block contact surface 164, as with the aspect of the y-axis endpin block 100 shown in FIGS. 3-7, or a cylindrical-ring-shaped tailgut-shaft-holder contact surface 166 may be placed around the endpin shaft holder 140, so as to enlarge the size and diameter of the tailgut-block contact surface 164 to be larger than the endpin shaft holder 140, so that the tailgut 162 is not made to traverse too a circle of too small a radius, which might stress or fatigue the tailgut 162, and which might lead to excessive pressure in too small an area of the tailgut-block contact surface 164—the tailgut-shaft-holder contact surface 166 serves to spread the pressure over a larger area, to avoid potential damage to the tailgut 162, the y-axis endpin block 100, and to the instrument 10. Such a tailgut-shaft-holder contact surface 166 may, it will be understood by one of skill in the art, be necessary because the endpin shaft holder 140 cannot be increased in diameter for all of its length, as the collar 150 must fit over the endpin shaft holder 140 for connection with the instrument 10. It will be understood by one of skill in the art that other aspects of the y-axis endpin block 100 are possible and may be advantageous, such as one in which the endpin shaft holder 140 has a larger diameter at its base, in the vicinity of where it connects with the rest of the y-axis endpin block 100, so that the larger diameter endpin shaft holder 140 serves as the tailgut-shaft-holder contact surface 166, obviating a need for a separate tailgut-shaft-holder contact surface 166.

In the aspect of the present invention of FIGS. 8-12, the y-axis endpin block 100 may further comprise two separate pieces: an endpin block lower part 122, and an endpin block upper part 124, as are shown. The endpin block lower part 122 may comprise the block barrel bore 106 and the block angled hole 104 and the block straight hole 102; the endpin block upper part 124 would in this aspect comprise none of those elements, and would by its smaller extent (in the x-y plane) relative to the endpin block lower part 122, make the space which is the tailgut wire opening 160.

In other aspects, the y-axis endpin block 100 of FIGS. 8-12 is similar to the y-axis endpin block 100 of FIGS. 3-7: both comprise a similar or identical y-axis barrel 130 with a barrel straight hole 132 and a barrel angled hole 134, the y-axis endpin block 100 comprises a block straight hole 102 and a block angled hole 104, and a similarly disposed block barrel bore 106, and barrel set screw bore 114, as well as an endpin shaft holder 140 and an endpin shaft bore 142; and the y-axis barrel 130 may be similar or identical, with similar or identical components, as described above in the present disclosure.

With reference to FIGS. 13-25, an aspect of the present invention referred to as an x-axis endpin block 200 is presented. The x-axis endpin block 200 is so called because an x-axis barrel 230 that holds the endpin 40 is parallel to the x-axis of the instrument 10, unlike the y-axis endpin block 100 with a y-axis barrel 130 described above. The x-axis endpin block 200 comprises an endpin block body 222, an x-axis barrel 230 and a block barrel bore 206 sized and disposed in the x-axis endpin block 200 to hold the x-axis barrel 230, a endpin shaft holder 140, a plurality of holes in the block for the endpin, a barrel screw 210, a tailgut-shaft-holder contact surface 266, and a plurality of elements for holding the endpin 40 at a desired angle relative to the x-axis endpin block 200, and optionally, a block-instrument contact pad 268.

Figure 19:
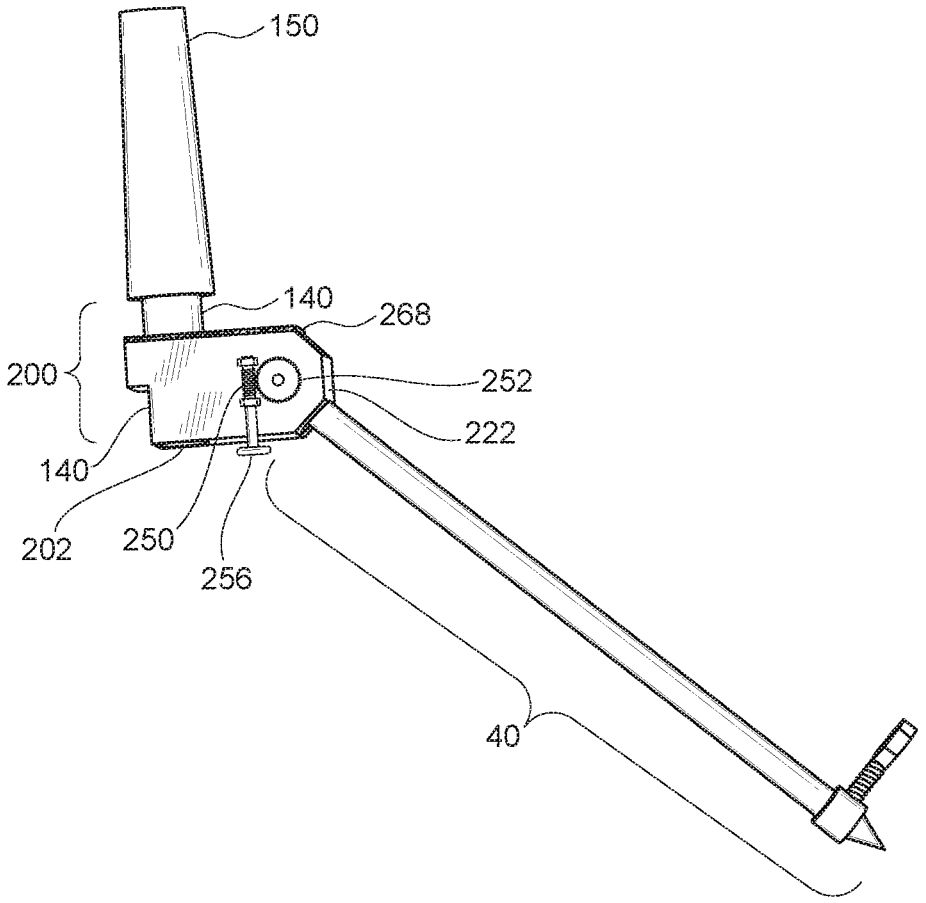
FIG. 19 shows a side perspective view of an exemplary endpin block apparatus of the present invention.
Figure 20:
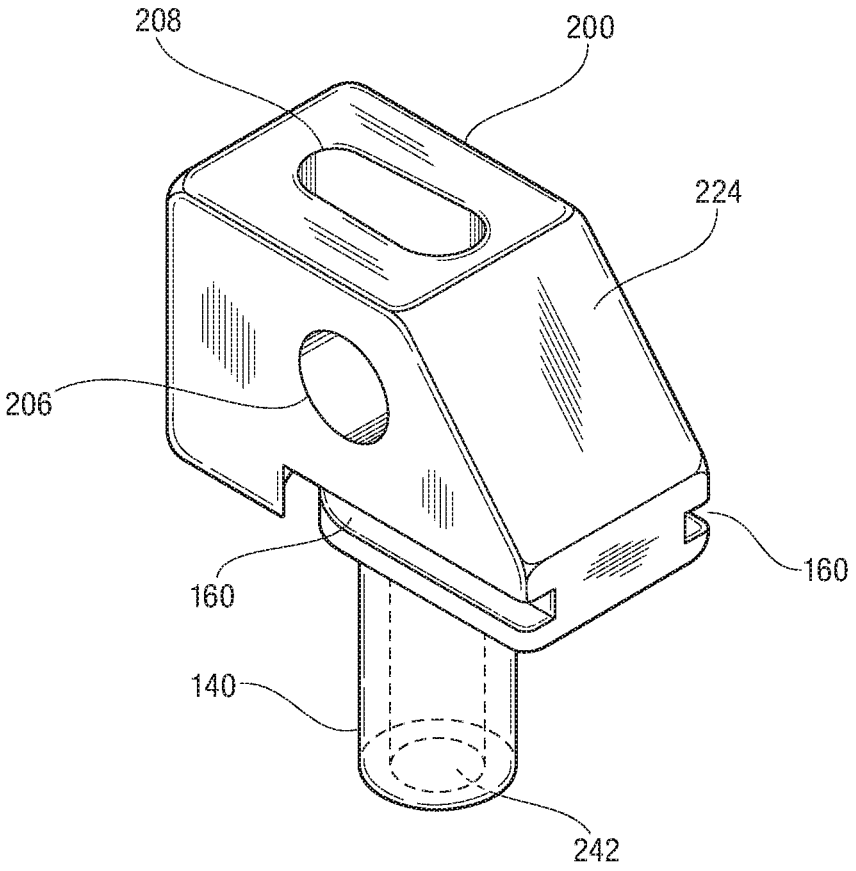
FIG. 20 shows a perspective view from below and to the side of an exemplary endpin block apparatus of the present invention.

The plurality of elements for holding the endpin 40 at a desired angle relative to the x-axis endpin block 200 may comprise, in some aspects of the present invention, a barrel set screw 112, which may be tightened against the x-axis barrel 230 to secure the x-axis barrel 230 at a desired angle. In other aspects of the present invention, the plurality of elements for holding the endpin 40 at a desired angle relative to the x-axis endpin block 200 may comprise a worm drive 250 and a barrel lock gear 252. The worm drive 250 may be external to the x-axis endpin block 200 or may be internal to the x-axis endpin block 200; in either case the worm drive 250 is securely mounted to the endpin block body 222. The barrel lock gear 252 is affixed to the x-axis barrel 230, and may be internal to the endpin block body 222, or external to the endpin block body 222 as shown in FIG. 19; in either case the barrel lock gear 252 must engage with the worm drive 250. The worm drive 250 can be turned, such as with a worm thumb screw 256 as illustrated in FIG. 19 or with an apparatus external to the present invention including but not limited to a screwdriver, and turning the worm drive 250 turns the barrel lock gear 252, which turns the x-axis barrel 230, so that the x-axis barrel 230 and with it the endpin 40 can be adjusted to any of a range of desired angles, and be secured there to remain at such a desired angle. In other aspects of the present invention, the worm drive 250 and the barrel lock gear 252 can be implemented with the block combined hole 208, as described below, to have a range of adjustment of the angles at which the endpin 40 can be fixed.

The x-axis endpin block 200 may be smaller than the y-axis endpin block 100, because the endpin block body 222 does not need to be as large as the y-axis endpin block 100 needs to be to hold the y-axis barrel 130. In some aspects of the present invention, the endpin shaft holder 140 may extend below the front portion of the endpin block body 222, because the endpin block body 222 does not need to contain a barrel in the front portion of the endpin block body 222.

In some aspects of the present invention, the plurality of holes in the x-axis endpin block 200 for the endpin 40 may comprise a block straight hole 202 and a block angled hole 204. The block straight hole 202 may be set directly in the endpin shaft holder 140, rather than matching up the block straight hole 102 and the barrel straight hole 132, as in the y-axis endpin block 100. For use with an endpin 40 in a traditional placement, the endpin 40 would be inserted in the block straight hole 202, pass through the full extent of the endpin shaft holder 140, and then through the collar 150 into the interior of the instrument 10. The x-axis barrel 230 further comprises a barrel screw 210, a barrel threading 236, and a barrel hole 234. The barrel screw 210, when engaged to tighten and traverse the barrel threading 236, may serve to secure the endpin 40 into the x-axis barrel 230, so that the endpin 40 cannot fall out of the x-axis barrel 230, and may serve to secure the x-axis barrel 230 in the x-axis endpin block 200.

For use with the endpin 40 in an angled position, the x-axis barrel 230 is inserted into the block barrel bore 206 with the block angled hole 204 in alignment with the barrel hole 234. The block barrel bore 206 comprises a void of size and shape to fit the x-axis barrel 230 and is disposed in the x-axis endpin block 200 parallel to the x-axis of the instrument 10 and nearly as long as, or as long as, the x-axis endpin block 200. It will be understood by one of skill in the art that the block barrel bore 206 may have a guide fin protrude from it, and a matching guide slot cut into the x-axis endpin block 200 surrounding the block barrel bore 206, so that the x-axis barrel 230 may only be inserted into the x-axis endpin block 200 properly aligned, so that the block angled hole 204 is aligned with the barrel hole 234. Similarly, the x-axis barrel 230 may have a guide slot cut into it, and the x-axis endpin block 200 may have a matching guide fin that extends into the space of the block barrel bore 206, so that the x-axis barrel 230 may be inserted only in proper alignment, as described above. In some aspects of the present invention, the x-axis barrel 230 may further comprise a plurality of barrel set screw detent holes 237, which the barrel set screw 112 may be locked or screwed into, to hold the x-axis barrel 230 at one of a plurality of angles as defined by the plurality of barrel set screw detent holes 237.

In some aspects of the present invention, the endpin 40 is inserted through the block angled hole 204 and into the barrel hole 234, and thereafter secured in the x-axis barrel 230 using the barrel screw 210. The endpin 40 may thereupon be adjusted to any desired angle, within the range of motion allowed by the oblong block angled hole 204, by tilting the endpin 40 relative to the z-axis of the instrument 10, and thereupon securing the x-axis barrel 230 in place using the barrel set screw 112. By tightening the barrel set screw 112, and fixing the x-axis barrel 230 in place, a musician 20 using the present invention may choose and set the endpin 40 at any desired angle, within the range of motion allowed for by the elongated block angled hole 204. It has been found advantageous to have the barrel hole 234 be round, and sized to snugly fit a traditional endpin 40, and to have the block angled hole 204 be elongated, such that the block angled hole 204 is approximately as wide as a traditional endpin 40, but in the y-z plane be elongated to allow the endpin 40 to be moved within a range of angles relative to the z-axis of the instrument 10. When the endpin 40 is rotated, by rotating the x-axis barrel 230 around an imaginary line parallel to the x-axis of the instrument 10, the endpin 40 sweeps out a portion of the y-z plane.

Figure 21:
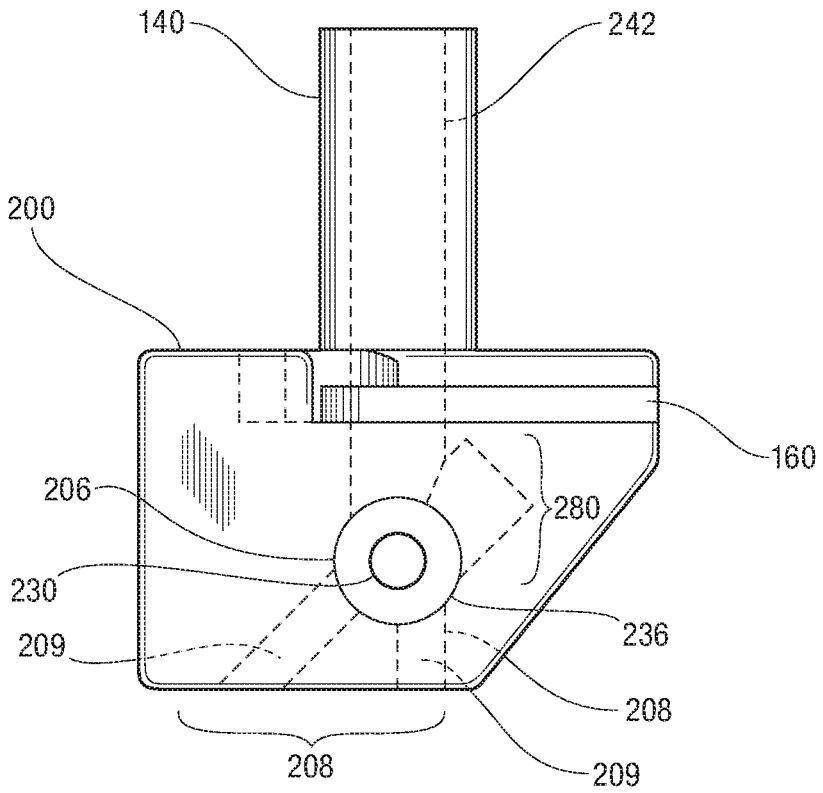
FIG. 21 shows a side elevation view of an exemplary endpin block apparatus of the present invention.
Figure 22:
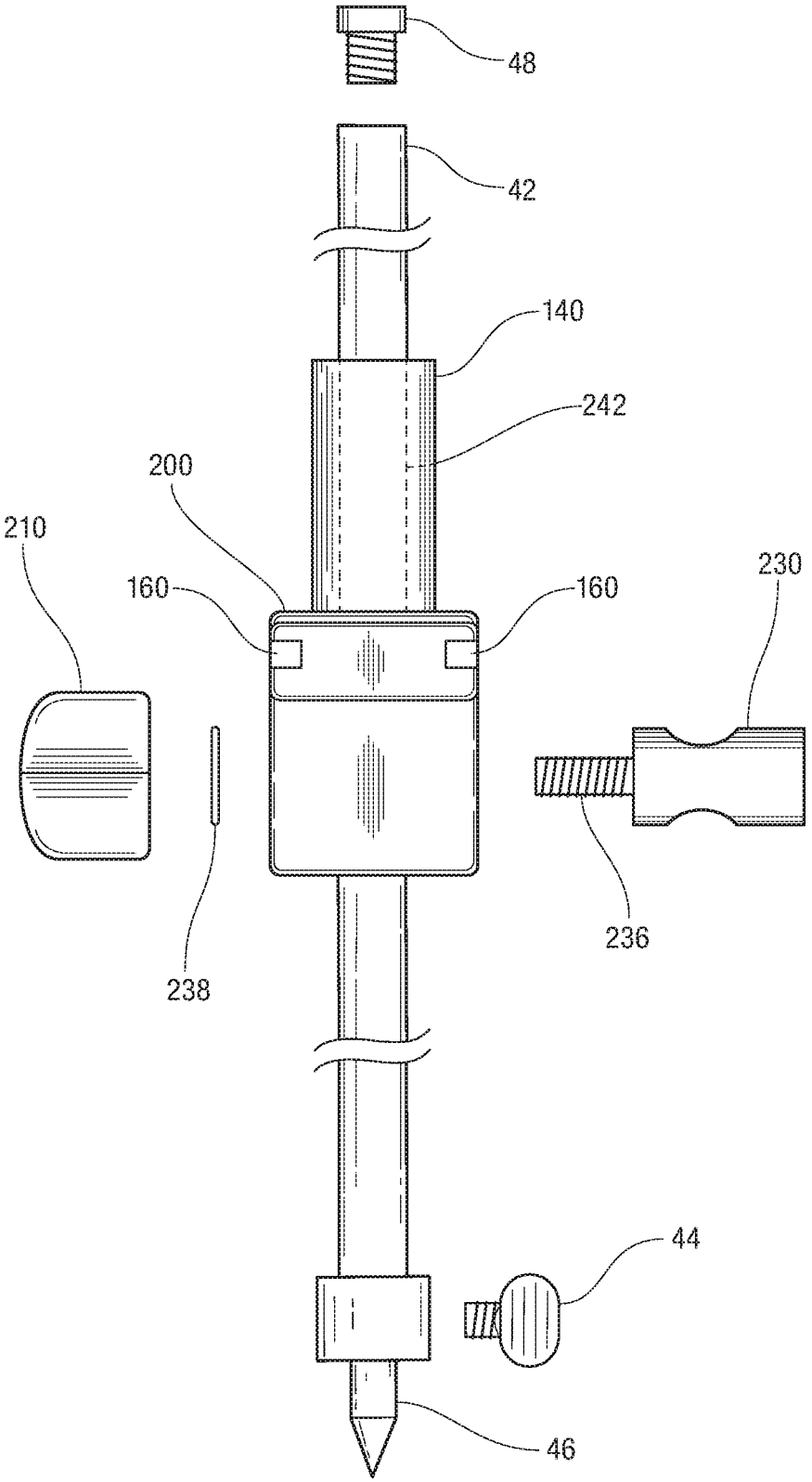
FIG. 22 shows a front elevation view of an exemplary endpin block apparatus of the present invention.
Figure 23:
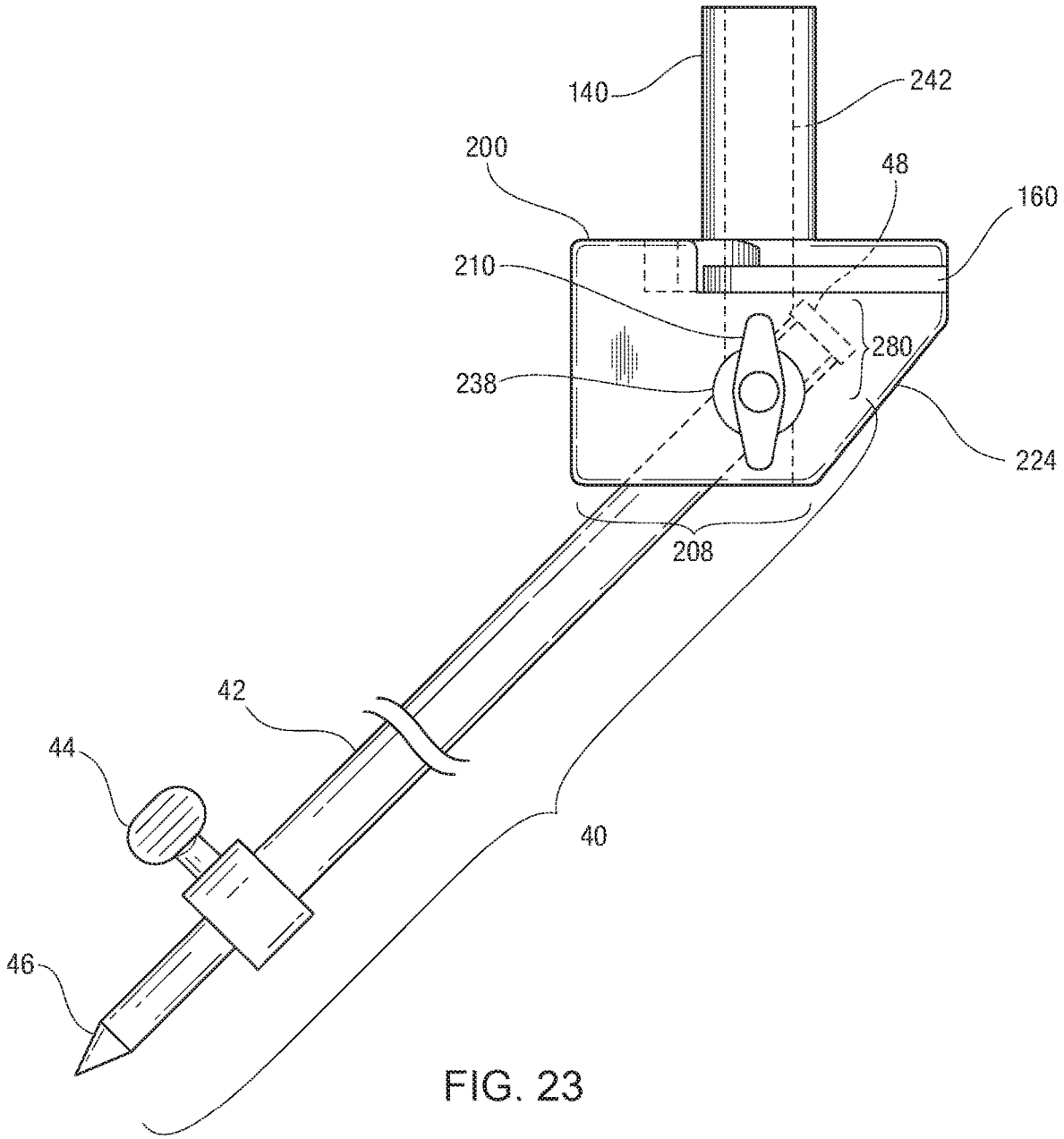
FIG. 23 shows a side elevation view of an exemplary endpin block apparatus of the present invention.
Figure 24:
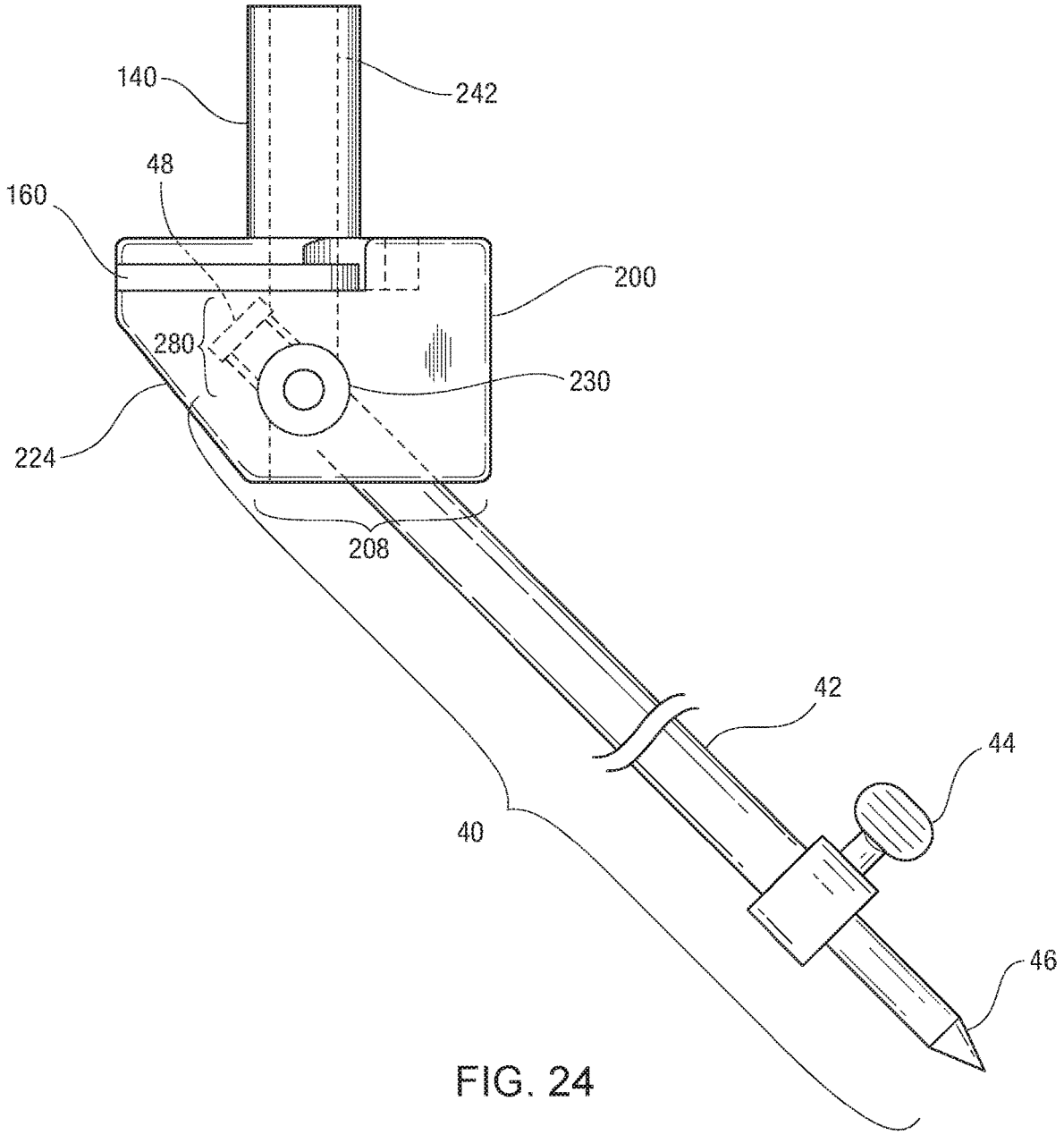
FIG. 24 shows a side elevation view of an exemplary endpin block apparatus of the present invention.
Figure 25:
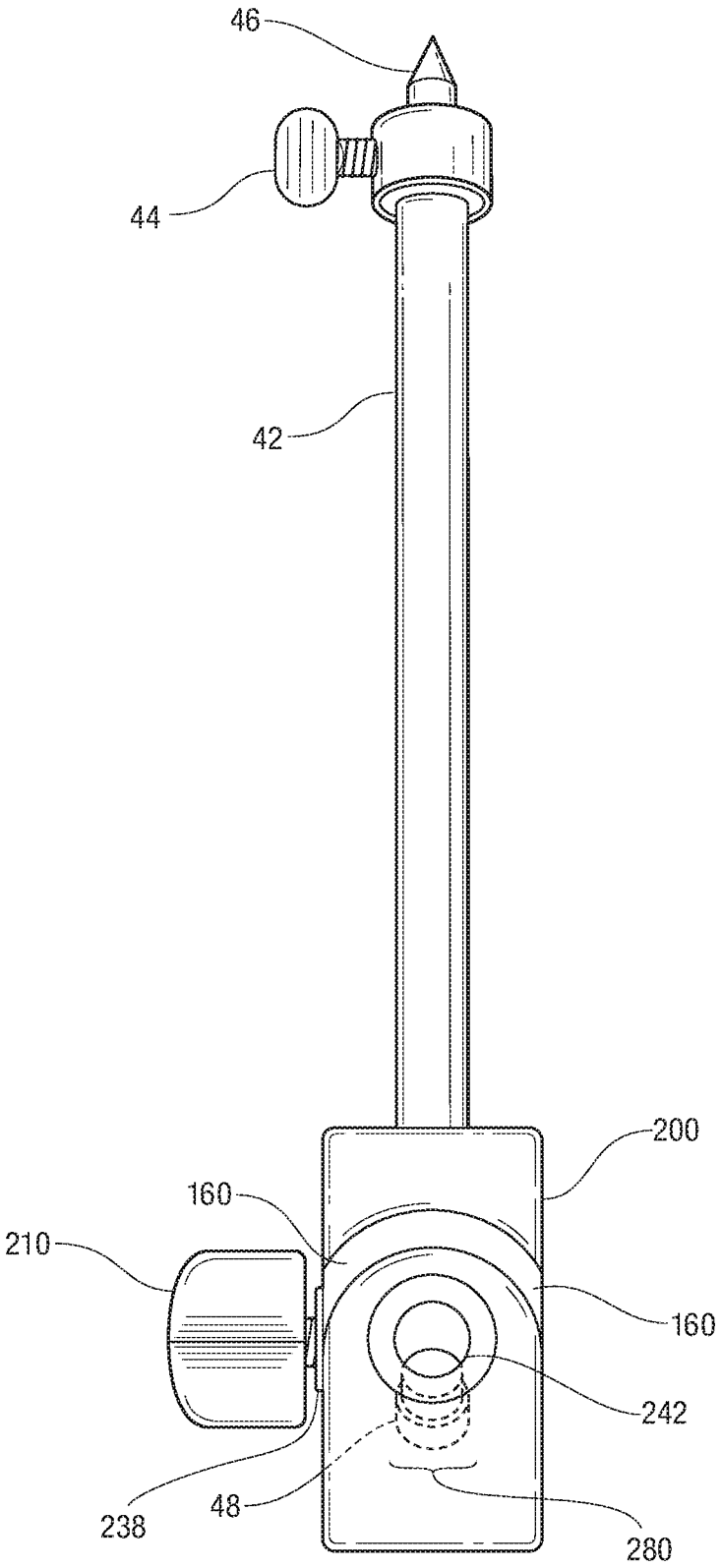
FIG. 25 shows a top elevation view of an exemplary endpin block apparatus of the present invention.

In some aspects of the present invention, the plurality of holes in the x-axis endpin block 200 for the endpin 40 may comprise a single block combined hole 208, and the front of the x-axis endpin block 200 may be shaped as a sloped front 224, which sloped front 224 provides a good space for the endpin screw 44 to be stored, when the endpin 40 is fully collapsed for storage and the instrument 10 is stowed in a case for the instrument 10, so that the endpin screw 44 has a convenient place to rest within the confines of most typical and available cases for instruments 10. The endpin 40 fits in the block combined hole 208, and may be adjusted to any of a range of desired angles if the plurality of elements for holding the endpin 40 at a desired angle relative to the x-axis endpin block 200 comprise a worm drive 250 and a barrel lock gear 252. In some aspects of the present invention, the plurality of elements for holding the endpin 40 at a desired angle relative to the x-axis endpin block 200 comprise an endpin stopper block void 280 inside the x-axis endpin block 200. In such embodiments, the endpin 40 must comprise an endpin stopper 48, affixed to the endpin top shaft 42 and with a larger external diameter than the endpin top shaft 42. The endpin 40 is passed through an endpin channel 242 (in the endpin shaft holder 140), through the barrel hole 234 of the x-axis barrel 230, and through the block combined hole 208. The endpin stopper 48, upon being pulled through the instrument 10 and down to the x-axis endpin block 200 and specifically to the x-axis barrel 230, is stopped by the x-axis barrel 230, as the external diameter of the endpin stopper 48 is larger than the barrel hole 234 and the endpin 40 is thus stopped from pulling completely through the x-axis barrel 230 by the endpin stopper 48, which rests against the x-axis barrel 230. When the endpin 40 is thus fully pulled to its maximum extend and is stopped by the endpin stopper 48, the x-axis barrel 230 may rotate inside the endpin block body 222 until the endpin stopper 48 reaches a rotated angle, at which the endpin stopper 48 and the endpin 40 are positioned in line with the endpin stopper block void 280, at a position illustrated in FIG. 23 and FIG. 24, and shown with the left-most of the two endpin 40 center lines 209 as shown in FIG. 21. The endpin 40 may then be pushed up, into the endpin block body 222 so that the endpin stopper 48 is securely seated into the endpin stopper block void 280, as shown in FIG. 23 and FIG. 24. The barrel screw 210, which may have an optional washer 238 placed between the endpin block body 222 and the barrel screw 210, may then be tightened, securing the x-axis barrel 230 to the endpin block body 222 and thus securing the endpin 40 at the desired angle.

The endpin stopper block void 280 is sized to securely hold the endpin stopper 48, and is disposed to hold the endpin 40 at a fixed angle. The fixed angle may be any angle, as different angles may be desirable to different players of an instrument 10, depending on the player's height and preferences. The present invention could be manufactured with, without limiting the foregoing, a fixed angle of 20°, or 30°, or 45°, or 60°, or 80°, or other angles, relative to the z-axis of the endpin block body 222. The endpin 40 may also be secured in a straight-through position, i.e. to be at 0° relative to the z-axis of the endpin block body 222, with the x-axis barrel 230 tightened to the endpin block body 222 with the barrel screw 210, which may have a washer 238 placed between the endpin block body 222 and the barrel screw 210. To illustrate these two possible positions of the endpin 40 when in use with some such aspects of the present invention, FIG. 21 illustrates where the endpin 40 center lines 209 would be, in the block combined hole 208, which block combined hole 208 comprises not just an opening in the bottom surface of the endpin block body 222, but also a void inside the endpin block body 222, through which void the endpin 40 may be rotated to either of the two end-extent positions shown in FIG. 21, FIG. 23, and FIG. 24 with dashed lines illustrating the extent of the block combined hole 208.

With the x-axis endpin block 200 described herein, the analogous structure or void of the tailgut wire opening 160 (of the y-axis endpin block 100 described above) may be the tailgut-shaft-holder contact surface 266 of the endpin shaft holder 140, which the tailgut 162 may contact directly. Because the tailgut-shaft-holder contact surface 266 of the endpin shaft holder 140 may, it has been found advantageous, be rounded in exterior profile, the x-axis endpin block 200 may be rotated about the z-axis of the instrument 10 when it is being assembled to the instrument 10, and before the tailgut 162 is secured to the apparatus of the present invention and the tailpiece 16, which puts the apparatus under tension and prevents it from further rotating about the z-axis. This feature of the present invention allows for rotation of the endpin 40 exit angle in a plane that is perpendicular to the x-y plane and rotated around the z-axis, which under the prior art is possible only with significant risks of damage to the instrument 10.

Certain aspects of the present invention were described above. From the foregoing it will be seen that this invention is one well adapted to attain all the ends and objects set forth above, together with other advantages, which are obvious and inherent to the system and method of the present invention. It will be understood that certain features and sub-combinations are of utility and may be employed without reference to other features and sub-combinations. It is expressly noted that the present invention is not limited to those aspects described above, but rather the intention is that additions and modifications to what was expressly described herein are also included within the scope of the invention. Moreover, it is to be understood that the features of the various aspects described herein are not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

What is claimed is:

1. An endpin block apparatus, for use with a stringed instrument and an endpin, referred to as an x-axis endpin block, the endpin block apparatus comprising:

an endpin block body, an x-axis barrel, a block barrel bore sized and disposed in the x-axis endpin block to hold the x-axis barrel, an endpin shaft holder, a block straight hole and a block angled hole, a tailgut-shaft-holder contact surface, and a worm drive and a barrel lock gear which engage with each other, and which barrel lock gear is affixed to the x-axis barrel, for holding the endpin at a desired angle relative to the x-axis endpin block; and in which the x-axis barrel further comprises a barrel screw, a barrel threading, and a barrel hole.

2. An endpin block apparatus, for use with a stringed instrument and an endpin, referred to as an x-axis endpin block, the endpin block apparatus comprising:

an endpin block body, an x-axis barrel, a block barrel bore sized and disposed in the x-axis endpin block to hold the x-axis barrel, an endpin shaft holder, a plurality of holes in the x-axis endpin block for the endpin, a tailgut-shaft-holder contact surface, and a plurality of elements for holding the endpin at a desired angle relative to the x-axis endpin block; and in which the x-axis barrel further comprises a barrel screw, a barrel threading, and a barrel hole; and in which the plurality of elements for holding the endpin at a desired angle relative to the x-axis endpin block comprise a worm drive and a barrel lock gear which engage with each other, and which barrel lock gear is affixed to the x-axis barrel.

3. The endpin block apparatus, for use with a stringed instrument and an endpin, referred to as an x-axis endpin block, of claim 2, in which the worm drive and the barrel lock gear are external to the x-axis endpin block.

4. The endpin block apparatus, for use with a stringed instrument and an endpin, referred to as an x-axis endpin block, of claim 2, in which the worm drive and the barrel lock gear are internal to the x-axis endpin block.

5. An endpin block apparatus, for use with a stringed instrument and an endpin, referred to as an x-axis endpin block, the endpin block apparatus comprising:

an endpin block body, an x-axis barrel, a block barrel bore sized and disposed in the x-axis endpin block to hold the x-axis barrel, an endpin shaft holder, a plurality of holes in the x-axis endpin block for the endpin, a tailgut-shaft-holder contact surface, and a plurality of elements for holding the endpin at a desired angle relative to the x-axis endpin block; and in which the x-axis barrel further comprises a barrel screw, a barrel threading, and a barrel hole; and in which the plurality of holes in the x-axis endpin block for the endpin comprise a block combined hole; and in which the plurality of elements for holding the endpin at a desired angle relative to the x-axis endpin block comprise a worm drive and a barrel lock gear, which worm drive is securely mounted to the endpin block body, and which worm drive is external to or internal to the x-axis endpin block, and in which the endpin fits in the block combined hole, and the endpin is adjustable to any of a range of desired angles.

6. An endpin block apparatus, for use with a stringed instrument and an endpin, referred to as an x-axis endpin block, the endpin block apparatus comprising:

an endpin block body, an x-axis barrel, a block barrel bore sized and disposed in the x-axis endpin block to hold the x-axis barrel, an endpin shaft holder, a plurality of holes in the x-axis endpin block for the endpin, a tailgut-shaft-holder contact surface, and a plurality of elements for holding the endpin at a desired angle relative to the x-axis endpin block; and in which the x-axis barrel further comprises a barrel screw, a barrel threading, and a barrel hole; and in which the plurality of holes in the x-axis endpin block for the endpin comprise a block combined hole; and wherein the plurality of elements for holding the endpin at a desired angle relative to the x-axis endpin block comprise an endpin stopper and an endpin stopper block void, inside the x-axis endpin block, sized to securely hold the endpin stopper; and which endpin stopper is affixed to an endpin top shaft and which endpin stopper has a larger external diameter than the endpin top shaft and a larger external diameter than the barrel hole; and the x-axis barrel may rotate inside the endpin block body until the endpin stopper reaches a rotated angle, at which the endpin stopper and the endpin are positioned in line with the endpin stopper block void; and at that rotated angle, the endpin may then be pushed up, into the endpin block body so that the endpin stopper is securely seated into the endpin stopper block void.

7. The endpin block apparatus, for use with a stringed instrument and an endpin, referred to as an x-axis endpin block, of claim 6, in which the desired angle is 45°.

* * * * *